US006131340A

United States Patent [19]

Clark et al.

[11] Patent Number: 6,131,340

[45] Date of Patent: Oct. 17, 2000

[54] SLIDING DOOR FOR BOAT CABIN COMPANIONWAY

[75] Inventors: Richard N. Clark, Farmington Hills; Philip E. Prystash, Brighton, both of Mich.

[73] Assignee: Tecla Company, Inc., Walled Lake, Mich.

[21] Appl. No.: 09/241,180

[22] Filed: Feb. 1, 1999

Related U.S. Application Data

[60] Provisional application No. 60/073,510, Feb. 3, 1998.

[51] Int. Cl.[7] ..... E05D 13/00; E05D 15/06; E05D 15/16; B63B 19/18

[52] U.S. Cl. ..... 49/410; 49/404; 114/202

[58] Field of Search ..... 49/426, 425, 410, 49/409, 404, 504; 16/93 R, 95 R, 91, 96 R, 90, 87 R; 114/202; 312/350, 139.2, 304; 52/219, 204.54, 0.5, 0.71

[56] References Cited

U.S. PATENT DOCUMENTS

| | | | |
|---|---|---|---|
| 1,118,721 | 11/1914 | Wiss . | |
| 1,181,331 | 5/1916 | Metzger . | |
| 2,507,497 | 5/1950 | Bowers . | |
| 2,569,763 | 10/1951 | Hofferberth . | |
| 2,599,747 | 6/1952 | Craigon . | |
| 2,613,844 | 10/1952 | Mounce . | |
| 2,627,092 | 2/1953 | Grossman . | |
| 2,646,949 | 7/1953 | Saulnier . | |
| 2,659,939 | 11/1953 | Greig . | |
| 2,704,866 | 3/1955 | Grossman . | |
| 2,996,844 | 8/1961 | Paulson . | |
| 3,425,162 | 2/1969 | Halpern . | |
| 3,800,488 | 4/1974 | Swanson | 52/217 X |
| 3,946,524 | 3/1976 | Budich . | |
| 4,335,547 | 6/1982 | Maxwell . | |
| 4,381,629 | 5/1983 | Ahn . | |
| 4,679,366 | 7/1987 | Hitchins | 52/217 |
| 4,782,630 | 11/1988 | Kleyn | 52/217 X |
| 4,787,184 | 11/1988 | Boidron | 52/217 |
| 4,833,829 | 5/1989 | Wilson | 49/426 |
| 5,224,297 | 7/1993 | Watkins | 49/426 X |
| 5,345,722 | 9/1994 | Mc Kann | 52/217 X |
| 5,379,518 | 1/1995 | Hopper | 52/204.54 X |
| 5,692,349 | 12/1997 | Guillemet | 52/204.54 X |
| 5,865,498 | 2/1999 | Grogan | 52/11 X |
| 5,901,511 | 5/1999 | Yoshida | 52/217 X |

*Primary Examiner*—Daniel P. Stodola
*Assistant Examiner*—Hugh B. Thompson
*Attorney, Agent, or Firm*—Reising, Ethington, Barnes, Kisselle, Learman & McCulloch, PC

[57] ABSTRACT

A weatherproof sliding door assembly for opening and closing a boat cabin companionway wherein upper and lower aluminum track C-channel rails are supported to extend generally horizontally above and below the companionway. Each rail has a hollow interior slideway and a longitudinally extending slot opening thereto. A flexible plastic door panel has upper and lower edges respectively juxtaposed to the upper and lower rails and slidably mounted therein by upper and lower slide and cap panel-clamping sub-assemblies respectively that are secured by clamping to the door panel upper and lower edges and that extend the full length thereof. Each sub-assembly has a first leg wall extending therefrom into the associated rail slideway via the rail slot opening and terminating therein in a glide carrier portion. A pair of glides are mounted on each glide carrier portion adjacent its longitudinally opposite ends and bear slidably on the rail slideway for supporting the door panel for sliding motion along the rails. Each said door slide glide has limited rotational freedom around the rail slideway axis so that, if either said slide sub-assembly or rail is twisted during installation or operation, such rotational freedom will compensate for either such twist, thereby enabling the door assembly to be mounted with the rails allowed to twist within certain limits when fastened down to conform to non-parallel or non-level boat hull surfaces to which they are mounted, either as manufactured or as distorted in operation by loading or wave motion causing structural twisting, without thereby inhibiting sliding motion of said door along said rails.

47 Claims, 8 Drawing Sheets

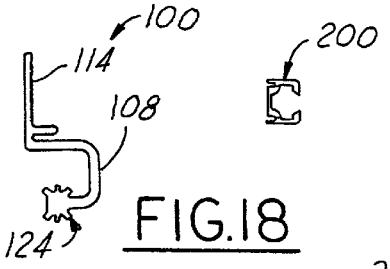
FIG.18
FIG.20
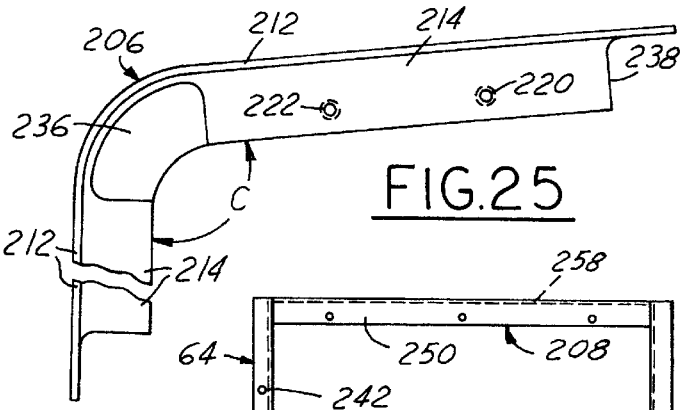
FIG.25
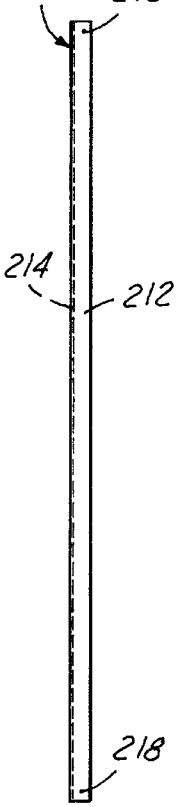
FIG.23
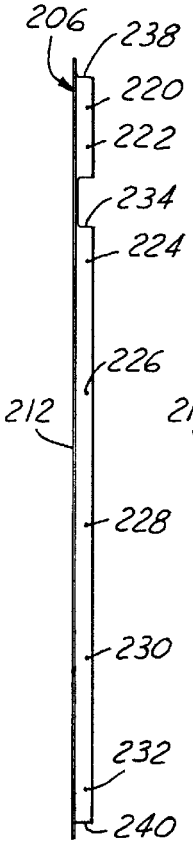
FIG.24
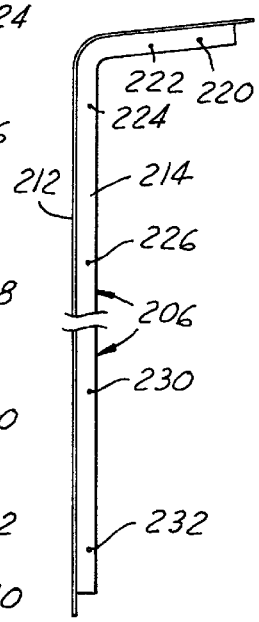
FIG.26
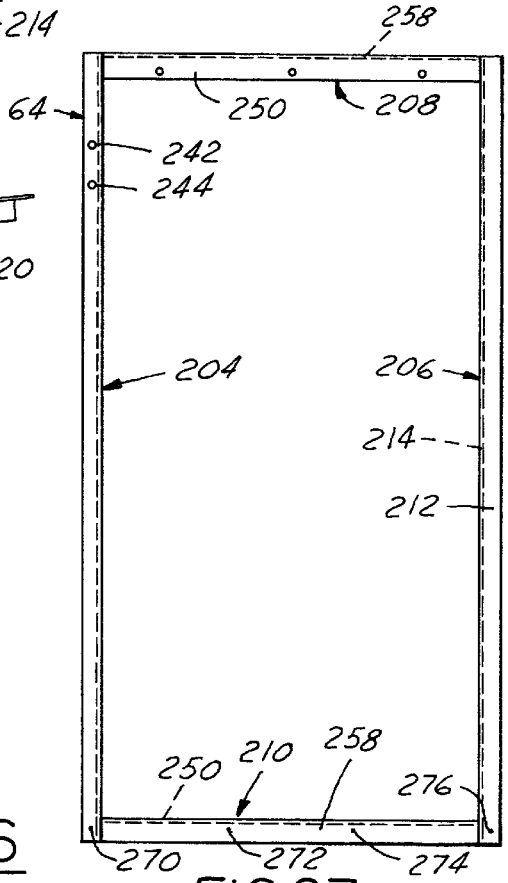
FIG.27
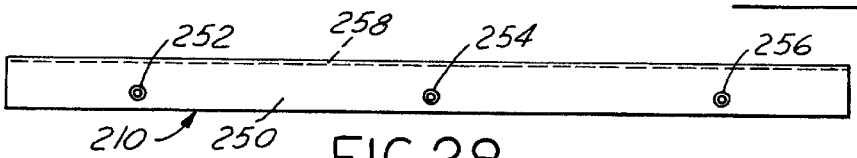
FIG.28
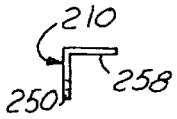
FIG.29
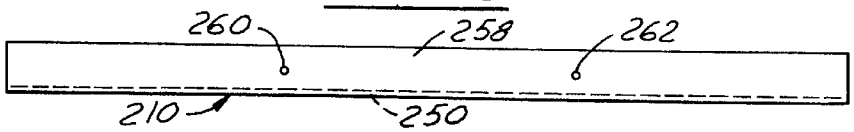
FIG.30

SLIDING DOOR FOR BOAT CABIN COMPANIONWAY

This is a United States regular utility patent application filed pursuant to 35 U.S.C. § 111(a) and claiming the benefit under 35 U.S.C. 119(e)(1) of the priority of United States Provisional Patent Application Ser. No. 60/073,510 filed Feb. 3, 1998 pursuant to 35 U.S.C. Section 111(b).

FIELD OF THE INVENTION

This invention relates generally to sliding doors and more particularly to a weatherproof sliding door assembly for use with a boat cabin companionway.

BACKGROUND OF THE INVENTION

The use of companionway closures is a very old art and has been commonly used in boat designs for boats of many types. For the class of water craft in the power boat category commonly referred to as "cabin cruisers", as well as pleasure sailing vessels commonly known as "cruising sailboats", primary access from the aft open cockpit area forward into the main cabin typically involves a companionway opening arranged in two planes. A portion of the opening is formed in the generally vertical bulkhead forming the aft wall of the cabin and separating the cabin from the cockpit area. The remaining companionway portion is generally formed in a horizontal or inclined plane as a notch-like large opening in the cabin overhead (ceiling wall). Due to the higher elevation of the cockpit bridge deck or sole (floor) relative to the cabin sole, the vertical dimension of the bulkhead opening is too short to allow standing entryway, and hence the need for the inclined or horizontal opening in the cabin overhead. Typically a sliding or hinged hatch is provided to open and close the companionway overhead, and likewise a hinged door, or sometimes a series of stacked boards, are used to close the bulkhead companionway opening. Such typical and conventional companionway closures are relatively expensive to construct, require a multiplicity of manipulation steps for their operation, and are difficult to seal tight against rain, wave splash water and hose down.

One approach in the prior art in an effort to eliminate problems associated with the aforementioned conventional companionway closures has been to provide a sliding door construction such as disclosed in Wilson U.S. Pat. No. 4,833,829 issued May 30, 1989. This door is constructed as a single panel configured to overlap both the overhead and bulkhead portions of the companionway. Such a sliding door construction eliminates the need for hinges as well as the extra clearance required for swinging hinged doors. The angled upper portion of the sliding door panel eliminates the need for a hinged upper panel or separate sliding hatch construction. The upper and lower edges of the door panel are fastened in "train bodies", each having a pair of four-wheel roller trucks closely tracking and captured in roller grooves formed in an extruded plastic open-slot channel rail.

The Wilson '829 sliding companionway door construction, although providing several advantages over any of the older traditional companionway closure constructions, still presents certain cost and operational problems due to the need to provide relatively close operational clearances between the track grooves and truck wheels. The upper and lower track rails must be carefully mounted on the supporting deck and bulkheads or overhead of the boat hull structure to insure close parallelism between the longitudinal axes of the track. Also the track rails must be mounted properly to align the major planes of the associated train body and door panel portion mounted therein centered in the track slot and extending perpendicular to the rotational axes of the wheels in order to prevent truck tilting and binding in the track wheel grooves. These rail and door orientation requirements in turn require that the track be securely mounted on a smooth flat surface so that no twist or fore-and-aft camber is imparted to the track throughout its longitudinal extent.

For the foregoing reasons, the Wilson '829 patent prescribes that this sliding door construction is best suited for a boat manufacturer that uses a precision mold to form (from plastic material, e.g., fiberglass) the hull entrance structure surrounding the companionway in order to insure uniformity in the configuration and dimensions of the door rail mounting structure of the boat. The Wilson '829 arrangement also requires the boat manufacturer to specially design into the companionway "surround" a raised weather sealing embossment in addition to seals carried on the top, bottom and both side edges of the sliding door. These special boat construction parameters, of course, entail additional boat manufacturing costs.

Moreover, in operation and use of the Wilson '829 patent sliding door system, the upwardly facing slot openings in the upper and lower track rails serve as dirt and debris catchers such that sand, salt and/or mud can easily enter and clog the wheel grooves in the track and thereby jam the door from sliding freely, or altogether. Removal and replacement of a damaged door panel is also a time consuming operation, and only one close tolerance thickness of door panel can be accommodated by a given installation.

Another prior art companionway sliding door construction is that manufactured and sold by Aluminum 2000, Inc., of Lancaster, Pa. This door assembly is similar to that disclosed in the aforementioned Wilson '829 patent, except that plastic slider glides are substituted for the four-wheel trucks and are permanently secured to the door panel for a close sliding fit in an associated rail groove. Thus, this Aluminum 2000 sliding door, like the Wilson sliding door arrangement, requires precision manufacture of the cabin and bulkhead walls, and must be precision installed so that the mounting hardware does not warp or twist the unit in any way. Failure to do so will cause the door to slide incorrectly and/or cause misalignment problems. Likewise the upper and lower track rails must be secured in close parallelism with the components of the door/glide system. In addition, like the Wilson system, some of the door hardware of the system, such as the strike plate and the door bumper stop, are separate components that must be carefully separately installed to the boat bulkhead structure. Accordingly, installation and operational problems also still remain in terms of door sliding interference from dirt and debris accumulation in the track rails and/or twist or distortion of the rails if mounted on uneven surfaces and/or out of precision alignment.

OBJECTS OF THE INVENTION

Accordingly, among the objects of the present invention are to provide an improved sliding companionway door system for cabin pleasure boats and the like that retains the advantages of the aforementioned prior art sliding companionway door construction in terms of utilizing a single panel door that slides to the side of the companionway entrance and thereby eliminates the usual door hinges, that permits a narrower passageway due to the door being installed outside of the companionway, that eliminates the need for a separate hinged or sliding upper panel or hatch in the cabin overhead, that is constructed using a plastic door and aluminum framework to eliminate re-varnishing or re-painting problems, that provides day lighting of the cabin interior due to the use of translucent plastic in the sliding door panel, and wherein all the components are non-corrosive, while at the same time providing many improvements over the aforementioned prior art companionway sliding door constructions in terms of:

1. Providing a complete door system with the door and upper and lower track channel rails pre-assembled to a frame assembly weldment and wherein the end stops, as well as the door latch and keeper, weather seals and mounting holes, are built into the unit, either with or without the unit including the frame assembly component.
2. Wherein the door slide system has rotational freedom around the sliding axis that permits relative rotation about this axis between the door slide and associated rail so that, if either the slide or rail is twisted during installation or operation, this rotational freedom will compensate for either twist.
3. Wherein the system can be mounted with the rails allowed to twist within certain limits when fastened down to conform to non-parallel or non-level boat structural surfaces to which they are mounted either as manufactured or as distorted in boat operation by cargo and/or wave motion loading causing hull twisting without thereby inhibiting sliding motion of the door and the rails.
4. Wherein the track channel rails are less likely to be infiltrated by dirt, debris, salt encrustation, etc., and even if this occurs, will still enable the door carrying supports to slide freely along their elevated bearing surfaces in the rails.
5. Wherein the rail construction is such as to enable reverse mounting of door supports relative to the rail, and wherein each rail can have at least three rotational mounting positions for enhancing the installation versatility of the system.
6. Wherein the slide and rail geometry form an improved labyrinth seal to seal out water and wind from entry through the cabin door opening via the top and bottom door rails when the door is closed.
7. Wherein the slide hardware that attaches to the top and bottom edges of the door panel both seals the top and bottom of the door and stiffens the same while also eliminating the need for expensive polishing of these upper and lower door panel edge surfaces.
8. Wherein the mounting of the slide glides in the associated track rail enables the door system to slide with manipulation-applied loads that are not entirely vertical or horizontal without thereby imparting bending stress on the door panel.
9. Wherein the bearing surfaces provided in the track rails are oriented to help shed dirt from accumulating thereon.
10. Wherein the operation of the sliding glides on the rail bearing surfaces tends to make these track rail surfaces, as well as the slides, self-cleaning.
11. Wherein each of the upper and lower slides is constructed for mounting the associated edge of the door panel in a water-tight fashion, is automatically adjustable to accommodate different thicknesses of door panels, and which enables the door panel to be easily removed from its slide mounting and easily replaced, and
12. Wherein the door assembly provides its own improved manipulatable door-open stop latch that is simple and durable in construction and is easier for the boat operator to use for holding the door in the open position.

Another object is to provide an improved sliding companionway door system incorporating the aforementioned features and advantages while at the same time being economical in construction, installation and maintenance, that is rugged, durable and reliable in use, easily operated and repaired, readily adaptable to aftermarket retrofit applications on older boats of wood as well as non-precision fiberglass construction in addition to being compatible with hulls of even precision fiberglass construction that nevertheless twist and flex when on the water.

Further objects of the invention are to provide a new and improved sliding companionway door system of the aforementioned character and also in which the weight of the door panel and associated components is directed downwardly on the bottom-mounted upper and lower track rails to thereby effectively eliminate bending-load imposed distortion of such tracks, wherein the tracks are extruded in a shape that provides dislodgement in any direction except longitudinally in the sliding direction of assembly, which eliminates the need for any lubrication of the components over an extended service life, which eliminates the need for the boat manufacturer to precision form the companionway entrance in order to insure uniformity in the configuration and dimensions of the entrance mounting surfaces, that provides a door panel that is somewhat flexible and will not crack under normal flexing of the boat structure, and wherein such normal flexing of the boat structure will not damage and impede operation of any of the components of the door system, that provides a sliding door companionway closure system that is attractive in appearance, moves smoothly and freely with less effort throughout the service life of the system, wherein the component parts are all fabricated of a non-corroding material, which utilizes an open end channel track rail that allows the efficient draining of water out of the ends of the track, and provides a system that is readily adaptable to the addition of a self-storing sliding insect screen and/or transparent plastic window.

BRIEF DESCRIPTION OF THE DRAWINGS

The foregoing as well as other objects, features and advantages of the present invention will become apparent from the following detailed description of the best mode presently known of making and using the invention and from the accompanying drawings (which are to engineering scale unless otherwise indicated) wherein:

FIGS. 18 and 19 are respectively an end elevational and vertical elevational CAD views of the exterior side of one of the two duplicate main slides of the assembly shown by itself.

FIGS. 20, 21 and 22 are respectively end, elevational and plan CAD views of the upper one of the two duplicate track channel rails utilized in the door assembly shown by itself.

FIGS. 23 and 24 are vertical elevational CAD views respectively of the aft and starboard sides of the port side vertical frame members of the door frame weldment assembly shown by itself and prior to imparting the bend curvature thereto.

FIGS. 25 and 26 are fragmentary starboard side elevational CAD views of the starboard vertical frame member after being bend formed to final configuration, FIG. 25 being shown on an enlarged scale over that of FIG. 26 and showing a corner plug plate weldment inserted as a filler into a corner notch provided to facilitate final bend forming of this frame component.

FIG. 27 is a vertical elevational CAD view of the aft side of the complete door frame assembly weldment.

FIGS. 28, 29 and 30 are respectively elevational, end and plan CAD views of one of the identical top and bottom horizontal cross members of the frame weldment of FIG. 27.

DETAILED DESCRIPTION OF PREFERRED EMBODIMENT

Figure 1:
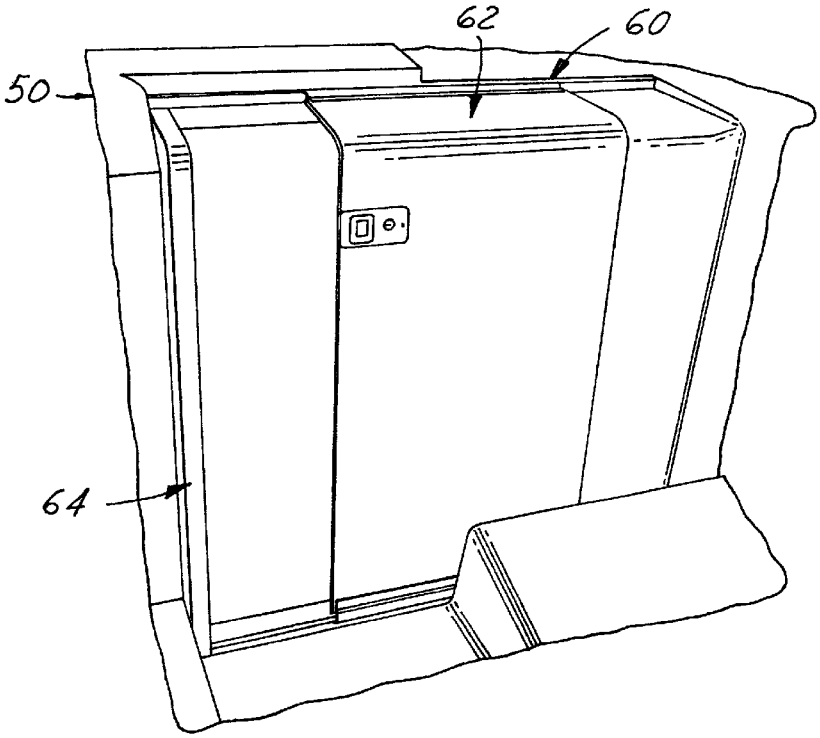
FIG. 1 is a perspective photo view of a companionway portion of a typical small cabin cruiser power boat with the sliding companionway door system of the invention installed thereon, as viewed from slightly above and aft of the door installation and with the door in a partially open position.
Figure 2:
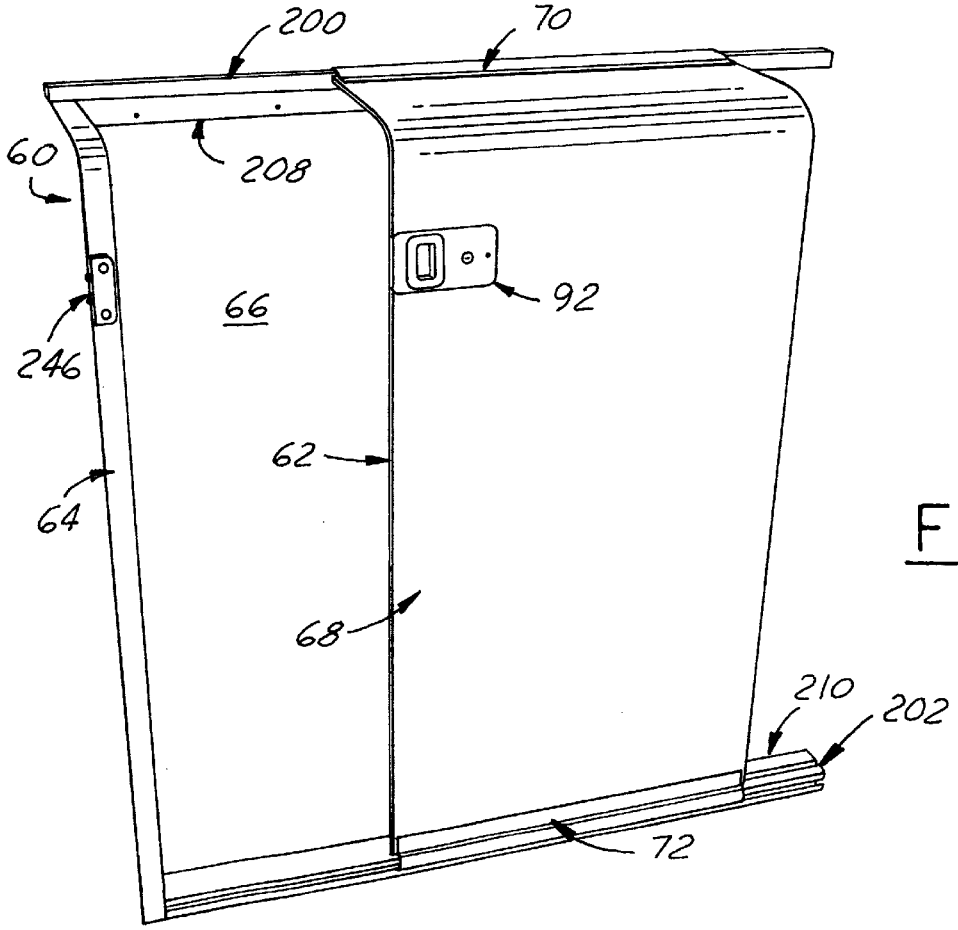
FIG. 2 is a perspective photo view of the sliding door system and associated support frame work shown by itself, with the door in an almost fully open position.

Referring in more detail to the accompanying drawings by numerals of reference, FIG. 1 illustrates a typical small power boat 50 with a sliding companionway door system 60 of the present invention installed for operation thereon. As seen more clearly in full assembly views of FIGS. 2, 3, 6 and 7 and in the fragmentary assembly views of FIGS. 4, 5, 8 and 9, door system 60 comprises two major sub-assemblies, namely, a door panel and slide sub-assembly 62 and a frame weldment and track rail sub-assembly 64 that is mounted to the boat cabin and cockpit structural walls for slidably supporting the door/slide sub-assembly 62 for opening and closing the companionway opening 66.

Door/Slide Sub-Assembly

Door/slide sub-assembly 62 comprises a one-piece door panel 68 (shown separately in more detail in FIGS. 10–12), an upper slide and cap sub-assembly 70, and an identically constructed lower slide and cap sub-assembly 72.

Door Panel 68

Figure 10:
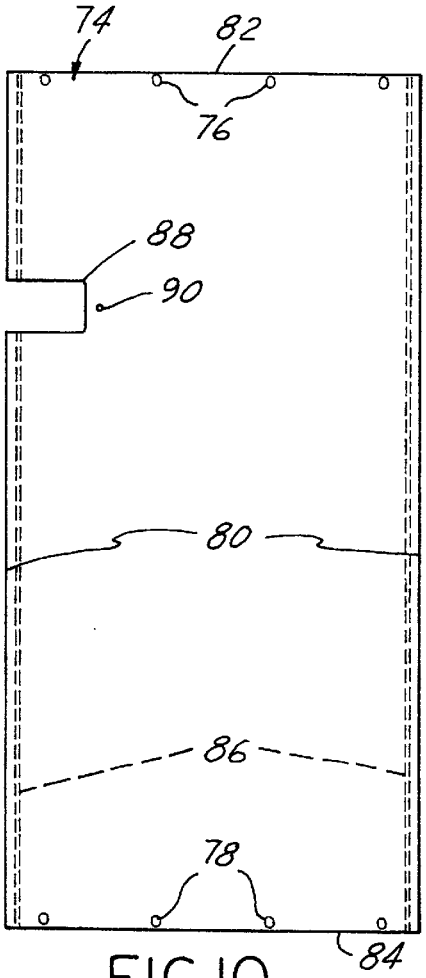
FIG. 10 is a vertical elevational CAD view of the machined, pre-form door panel component shown by itself.
Figure 11:
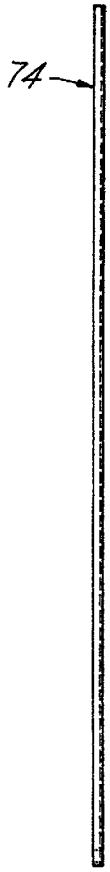
FIG. 11 is a side elevational CAD view of the door panel pre-form of FIG. 10.
Figure 12:
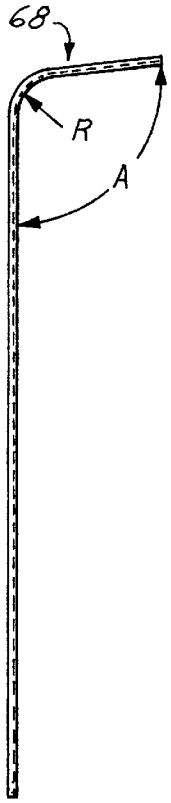
FIG. 12 is a side elevational CAD view of the door panel of FIGS. 10 and 11 shown by itself after being bend formed about a transverse radius near its upper end to provide its final in-use configuration.

Referring more particularly to FIGS. 10, 11 and 12, door panel 68 is initially made as the flat pre-form 74 (FIGS. 10 and 11) from a sheet of semi-resilient material, preferably one-half inch thick (nominal) acrylic plastic which is translucent and somewhat flexible. A horizontal row of four oblong mounting slots 76 are machined into the upper edge of panel 74, and a similar row of mounting slots 78 likewise machined into the lower edge of panel 74. Preferably the major axis of the slots and opposed slot side walls parallel thereto extend straight and longitudinally of the panel for facilitating installation adjustment. Preferably the port and starboard front longitudinal edges 80 of the panel are radiused by machining, but the upper and lower edges 82 and 84 of panel 74 may be left in their rough cut state. Longitudinally extending dovetail grooves 86 are machined into the forward face of panel 74, one adjacent each of the port and starboard edges of the panel, for retaining suitable weather seal strip material therein, preferably of the conventional brush type (not shown). A large notch 88 is machined in the port side edge of the panel and a mounting hole 90 is formed panel 74 adjacent notch 88 for mounting the conventional door lock hardware 92.

Figure 4:
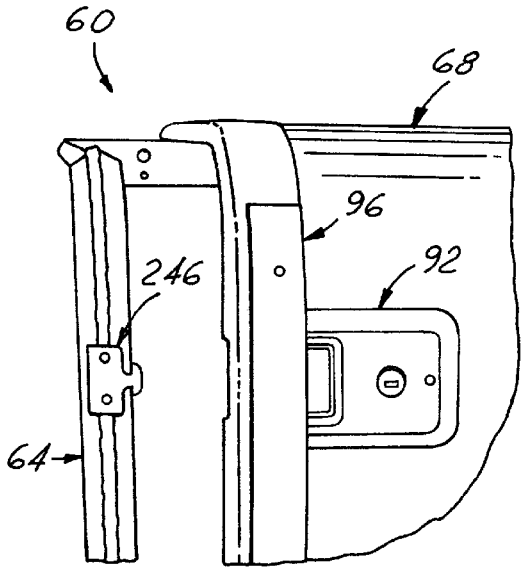
FIG. 4 is a fragmentary perspective photo view illustrating the port side of the door and frame with a door handle mounted on the door and the door slightly opened.
Figure 5:
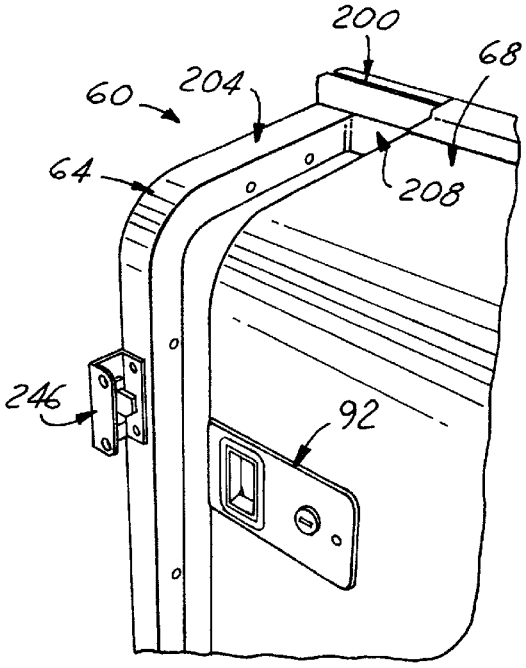
FIG. 5 is a photo view corresponding to FIG. 4 but looking forward and to port of the assembly.

After panel pre-form 74 is so machined, the same is permanently bent forward near its upper edge, as shown in FIG. 12, about the large bend radius R through an included angle A, which in the illustrated embodiment is 96.5 degrees. The commercially available flat or flush type spring latch mechanism 92 is mounted to the door in notch 88, as best seen in FIGS. 4 and 5. Likewise a door pull handle 96 is mounted to the exterior, aft surface of door panel 68 adjacent the port edge of the door, as shown in FIG. 4.

Slide/Cap Sub-Assembly

The details of upper and lower slide/cap sub-assemblies 70 and 72 of door sub-assembly 62 are best seen in FIGS. 13–19. Each of the slide/cap sub-assemblies 70, 72 includes a main slide extrusion 100, a cap extrusion 102 and two pairs of identical plastic glides 104 and 106.

Main Slide

Figure 6:
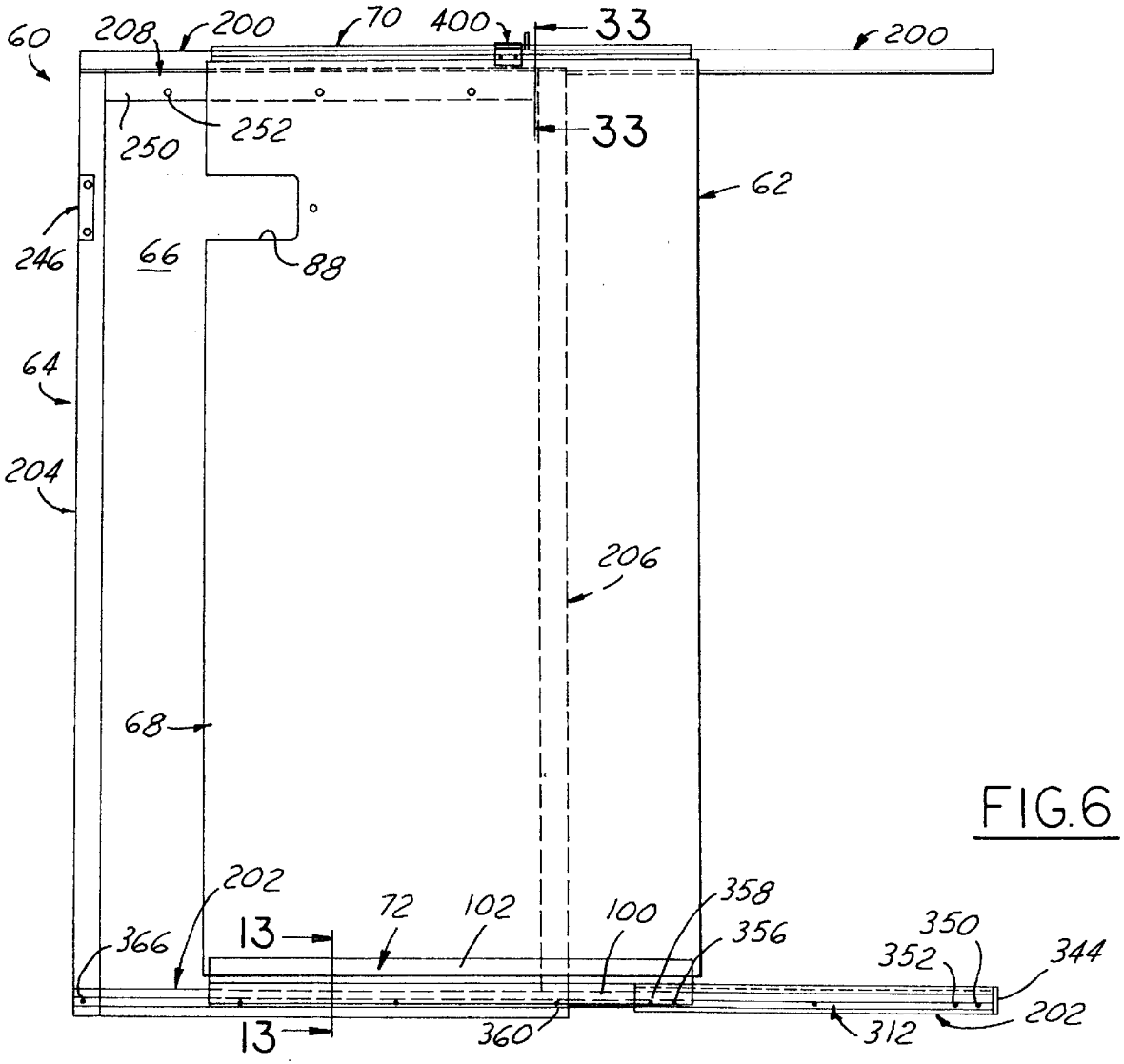
FIG. 6 is a vertical elevational engineering CAD view of the door and frame system assembly.
Figure 8:
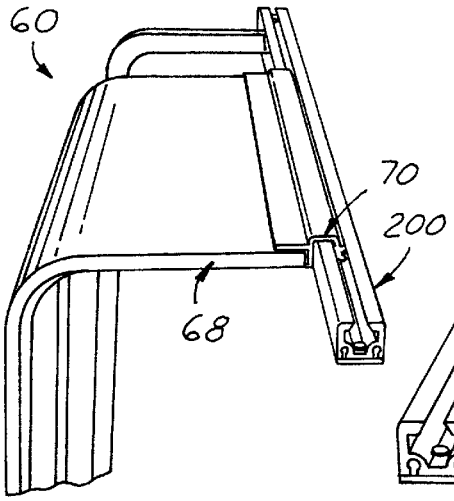
FIG. 8 is a fragmentary perspective photo view of the upper portion of the door and frame assembly with the door in partially opened condition as viewed from starboard looking to port of the assembly.
Figure 9:
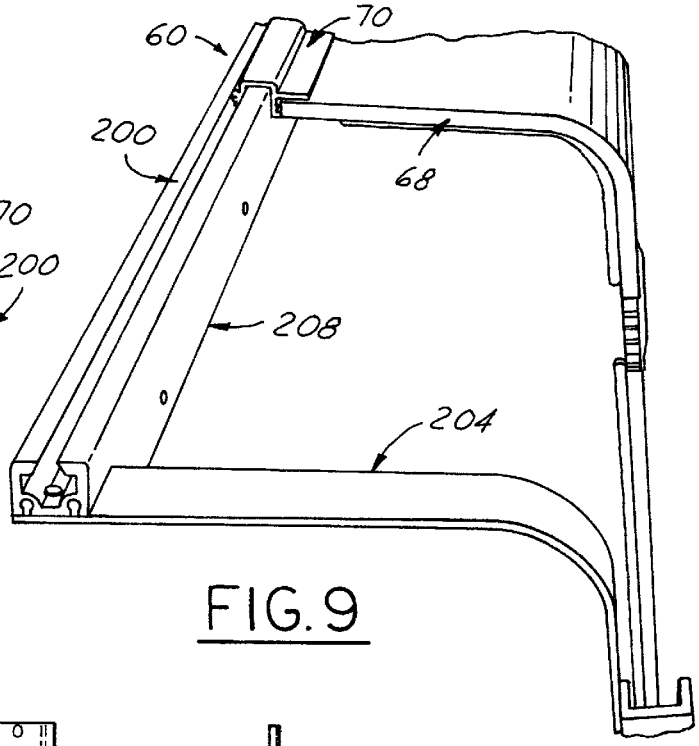
FIG. 9 is a photo view similar to FIG. 8 but enlarged thereover and of the port side looking to starboard.
Figure 17:
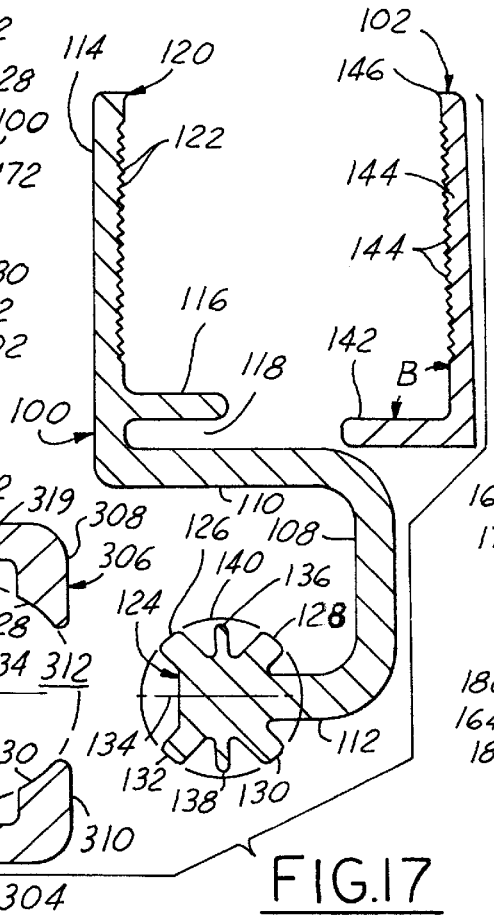
FIG. 17 is an exploded cross-sectional assembly CAD view of the lower track rail, slide and cap components of FIG. 13, but shown on a greatly enlarged scale thereover.

Main slide 100 is formed as an aluminum extrusion of constant cross sectional configuration and extends lengthwise substantially the full width of door panel 68 (FIG. 6). As best seen in FIG. 17, slide 100 has a U-shaped channel section made up of a central bight wall portion 108 integrally joined through radiused corners to an upper leg wall 110 and to a lower leg wall 112 that extend parallel to one another. The outer edge of upper leg wall 110 is joined through a radiused corner to a panel clamp leg wall 114 that extends with its major plane perpendicular to that of leg wall 110 and parallel to that of bight wall 108. A keeper leg wall 116 protrudes from leg wall 114 adjacent leg wall 110 and is spaced therefrom to define a cap keeper slot 118 therebetween. The upper outboard-facing longitudinal edge of leg wall 114 is provided with a small radius protruding lip 120. The outboard-facing surface of leg wall 114 is provided with a row of longitudinally extending teeth 122, preferably formed symmetrically with a 90 degree root angle and with a depth of 0.020 inches.

Lower leg wall 112 of slide 100 terminates at its free end in a ribbed glide carrier portion 124 best seen in cross section in FIG. 17. Carrier 124 is formed as a terminal integral enlargement of leg wall 112 and has four longitudinally extending and radially protruding major or thick ribs 126, 128, 130 and 132, each having its major mid-plane oriented at an included angle of 45 degrees relative to the mid-plane 134 of leg wall 112. Ribs 126–132 thus form diametrically oppositely protruding pairs 126/130 and 128/132. A pair of minor or thin ribs 136 and 138 are formed co-planar with their major plane perpendicular to plane 134 so as to protrude respectively between major ribs 126 and 128 and between ribs 130 and 132. Preferably ribs 126–132 have a cross sectional thickness of 0.090 inches, whereas ribs 136 and 138 have a cross sectional thickness of 0.040 inches. The outer end edges of the ribs 126–132 are edge-rounded and terminate flush with an imaginary circle 140, preferably having a diameter of 0.526 inches. The outer end edges of thin ribs 136 and 138 terminate slightly short of circle 140, as shown in FIG. 17.

Slide Cap

Figure 13:
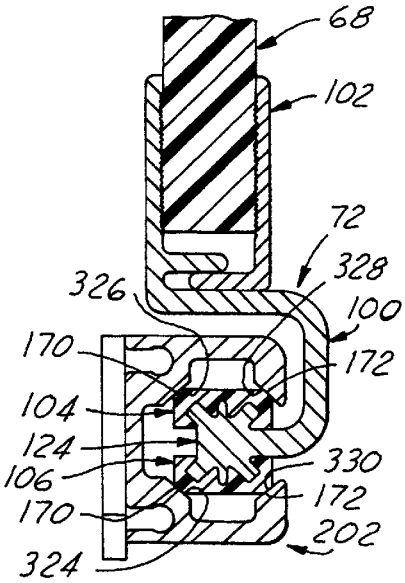
FIG. 13 is a fragmentary cross sectional CAD view taken on the line 13—13 of FIG. 6.
Figure 14:
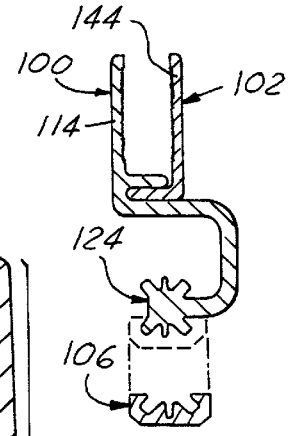
FIG. 14 is a cross sectional CAD view of the door slide/cap sub-assembly of FIG. 13 shown by itself, and with one of the lower glides spaced therefrom to indicate one mode of assembly onto the ribbed carrier support of the slide extrusion.

As shown in FIGS. 13, 14 and 17, slide cap 102 of each slide/cap sub-assembly 70, 72 is L-shaped in transverse cross section, is co-extensive in length with slide 100 and is likewise formed as an aluminum extrusion of constant cross sectional configuration. The narrow width leg wall 142 of cap 102 is designed to slip fit into keeper slot 118 of slide 100 so as to be adjustably captured between wall leg 110 and keeper wall 116 of slide 100 in assembly therewith. The wider leg wall 144 of cap 102 is formed with its major plane defining an included angle B (FIG. 17) slightly less than 90 degrees, preferably 88 degrees, relative to the major plane of the narrow wall 142. Cap 102 in assembly with slide 100 (FIGS. 13 and 14) is oriented with its upper end flush with that of slide 100. Cap 102 has a longitudinal rib 146 at its upper edge, facing rib 120, and a row of longitudinally extending teeth 148 facing teeth 122 and of identical configuration.

Four mounting holes 150, 152, 154 and 156 (FIG. 19) are provided in each slide 100 for alignment with holes 76 (in the case of upper slide/cap sub-assembly 70) or with holes 78 (in the case of lower slide/cap sub-assembly 72). Each cap 102 is likewise provided with four mounting holes (not shown) oriented identically with slide holes 150–156 for axial alignment therewith in assembly.

Glides

Figure 15:
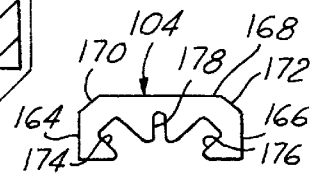
FIG. 15 is a side elevational CAD view of one of the glides.
Figure 16:
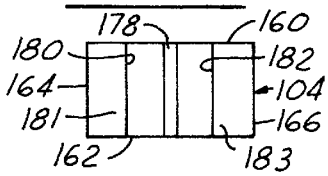
FIG. 16 is a bottom plan CAD view of glide of FIG. 15.
Figure 19:
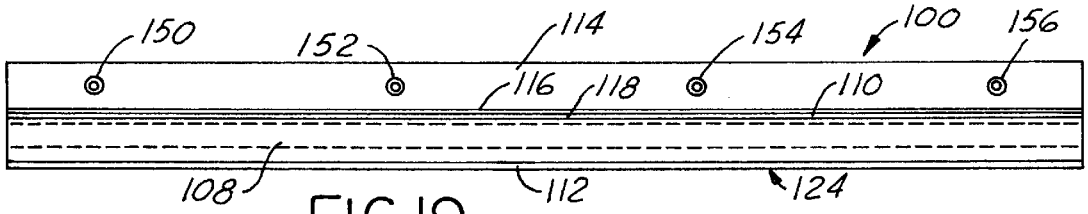

The two upper glides 104 and the two identical lower glides 106 of each slide/cap sub-assembly 70, 72 are identical with one another and are each constructed as shown in FIGS. 15 and 16. A suitable length of material having a cross sectional configuration as shown in FIG. 15 is extruded or injection molded from which individual glides 104, 105 are cut or molded at equal length increments. Preferably the material selected is ACETRON®, a filled acetal, but other brands of filled acetal or DELRIN® plastic filled with TEFLON®, graphite or oil are also satisfactory glide materials because of their self-lubricating properties that reduce sliding friction to an acceptable level. Each glide 104 is rectangular in plan view (FIG. 16) with flat parallel opposite side surfaces 160, 162 (FIG. 16), flat and parallel end faces 164, 166, a flat top surface 168 and oppositely inclined track-engaging slide surfaces 170 and 172 intersecting the respectively associated end surfaces 164 and 166 at a 45 degree angle. Each glide 104, 106 is formed with oppositely angled major grooves 174 and 176 complementary in configuration to carrier major ribs 126 and 128, (and ribs 132 and 130), and a central minor groove 178 complemental to carrier minor ribs 136 or 138. The plastic material of each glide 104, 106 renders the same semi-resilient. The material removed in the formation of grooves 174–178 thus enables yieldable bending of each glide in the plane of the drawing of FIG. 15, thereby widening the gap between the rounded edges 180 and 182 (FIG. 16) of the associated re-entrant gripping fingers 181 and 183 formed in the bottom side of glide 104 by the provision of grooves 174 and 176.

To assemble each glide 104 onto slide carrier 124 during manufacture, cap 104 is oriented adjacent a longitudinal end of the carrier with its grooves 174,176 and 178 aligned with ribs 126, 128 and 136, respectively, and then slid sideways onto these ribs, as shown in FIG. 13, to a position approximately one inch inward from the associated end of carrier 124. Likewise lower glide 106 is inserted sideways onto its associated ribs 130 and 132 and 138 as shown in FIG. 13 to a position approximately one inch inward from the same end of carrier 124. Then, in order to capture each glide within a limited range of sliding motion longitudinally of carrier 124, the small rib 136 is struck out slightly to produce two limit stop tangs, one on either side of each glide 104. Likewise small rib 138 is struck out on either side of glide 106 to likewise capture it for a limited range of sliding motion on carrier 124. A spacing of about one inch between the two flanking strike outs of these center ribs has been found to be adequate for this purpose. Another pair of glides 104 and 106 is similarly installed and travel-limited on the opposite longitudinal end of carrier 124.

Once the glides have been so constrained for limited longitudinal travel on carrier 124, they still may be removed and replaced by "peeling off" the glide due to its semi-resilient characteristics and configuration that permits yieldable bending of the glide in a plane perpendicular to the longitudinal axis of the carrier 124. Likewise, re-installation, or installation of replacement glides, between the travel-limiting strike outs in the center ribs may be accomplished manually assisted by pliers to apply sufficient mounting distortion forces to snap the glide onto seated position on the associated three ribs. This sidewise installation procedure is generally indicated by the phantom lines in FIG. 14.

To complete the assembly of the door/slide sub-assembly 62, the lower edge of door panel 68 is inserted between leg wall 114 of slide 100 and leg wall 144 of cap 102 as shown in FIG. 13. Suitable fasteners 190 (FIGS. 31 and 32) may be pre-inserted through the mounting holes 150–156 of slide 100 and panel 68 oriented to register holes 78 with fastener ends so that they protrude through the exterior surface of panel 68. Cap 102 is likewise registered with its mounting holes on protruding fastener ends and then drawn up tight as the fasteners are secured to insert clamping pressure by leg wall 114 and leg wall 144 on the edge portion of the door panel captured therebetween. Preferably the type of fasteners employed for this purpose are stainless steel 10-32 flathead bolts and cooperative PEMS fasteners. Preferably the fasteners are accessible for installation and removal only from the back side of the door to thereby render the door tamper resistant.

The oblong holes 76, 78 allow for adjustment of the door after the door is initially so mounted. This allows for misalignment compensation between the door seal and the seal surface due to hull mold imperfections, slight misalignment of the door rails or dimensional variations resulting from bend forming of the door. The oblong holes 76, 78 can be injected with silicone rubber (or like adhesive sealant) after such final adjustment such that curing of the sealant locks the adjustment in place.

Figure 33:
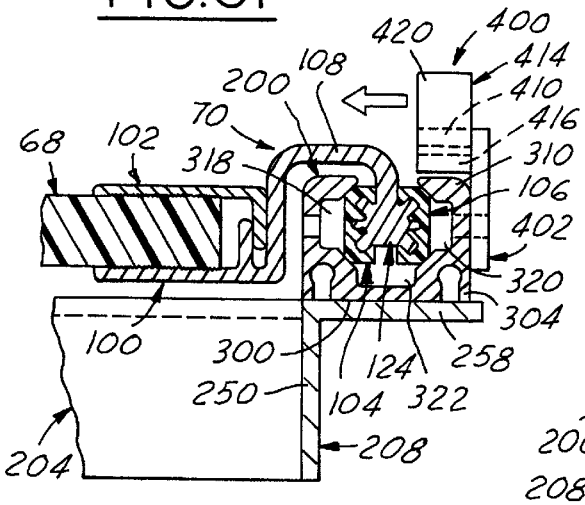
FIG. 33 is a cross sectional CAD view taken along the line 33—33 of FIG. 31.

The serrations 122 and 148 of the slide 100 and cap 102 function to grip the acrylic material of the door panel securely as so installed. The small raised longitudinal lips 120 and 146 further enhance the gripping action on the acrylic door panel and form a water seal at the weather side interface of this joint. The inclination angle B of the cap wall 144, in cooperation with the close sliding fit of cap leg wall 142 into slot 118 in assembly, causes lip 146 of cap 102 to grip more tightly than those serrations 148 most remote therefrom to further enhance the water tight seal achieved during this installation. The upper slide/cap sub-assembly 70 is installed to the upper edge of door panel 78 in the same manner and to the same effect as shown in FIG. 33.

Frame/Rail Sub-Assembly

Figure 7:
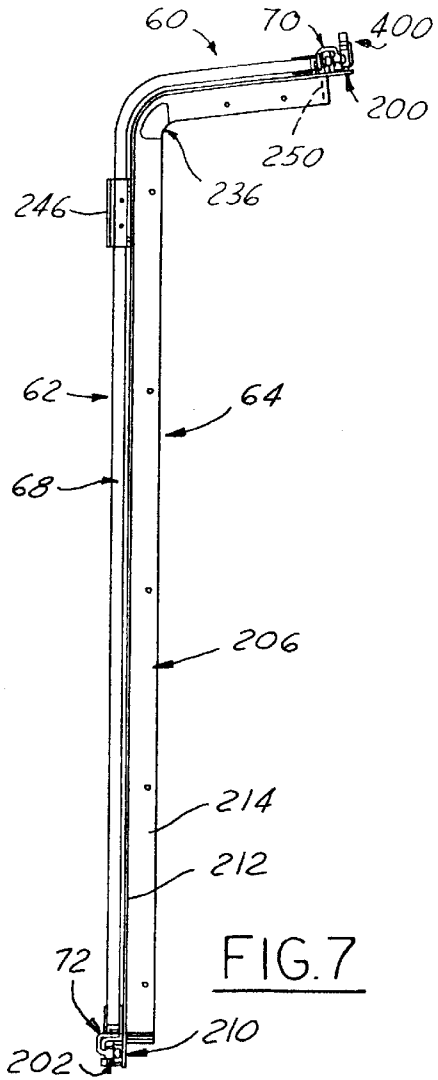
FIG. 7 is a starboard side elevational CAD view of the door assembly of FIG. 6 as viewed looking to port.

The frame/rail sub-assembly comprises the frame assembly weldment 64 and a pair of identical upper and lower track rails 200 and 202, respectively, that are detachably fastened to the upper and lower edges of frame weldment 64 (FIGS. 6 and 7).

Frame Weldment 64

Referring more particularly to FIGS. 23–30, frame weldment 64 is composed of port and starboard upright frame sections 204 and 206, respectively, that extend parallel to one another with appropriate lateral spacing therebetween to match the associated boat hull structure defining the port and starboard side edges of the companionway 66. Uprights 204 and 206 are interconnected at their upper and lower ends by an upper frame section 208 and a lower frame section 210, respectively. The starboard upright frame section 206 is shown as a pre-form in the detail views of FIGS. 23 and 24. Frame section 206 is a right angle channel member having an aft-facing front flange 212 and a side flange 214. Front flange 212 is provided with upper and lower mounting holes 216 and 218 for receiving suitable screw fasteners, and likewise side flange 214 is provided with a row of seven mounting holes 220, 222, 224, 226, 228, 230, 232 countersunk on the starboard side for receiving flathead mounting screws. As seen in FIGS. 24, 25 and 27, the upper and lower end edges 238 and 240 of flange 214 are in-set from the associated end edges of flange 212.

Frame section 206 is shown in FIGS. 25, 26 and 27 as bend-formed to its final assembly configuration with the upper portion of the section bent at angle C (FIG. 25), such as 97 degrees, to match the particular configuration of the boat hull structure defining the overhead portion of the companionway opening 66. To accommodate such bend formation, a cut-out notch 234 (FIG. 24) is formed in side flange 214. After bending the pre-form to through angle C, the notched out area is filled with a filler piece 236 (FIG. 25) inserted into the re-configured notch opening and secured by welding at its edges to the edges of the reformed notch.

The port upright frame section 204 is formed as a mirror image of starboard upright section 206 and is otherwise identical in formation and structure, except that two mounting holes 242, 244 (FIG. 27) are provided for mounting of a strike plate 246 (FIGS. 6 and 7).

The top and bottom horizontal frame sections 208 and 210 are constructed identically to one another, bottom section 210 being shown by itself in the detail views of FIGS. 28, 29 and 30. These frame sections 208, 210 are also right angle channel sections. The top flange 250 of section 210 is provided with three screw mounting holes 252, 254, 256 (FIG. 28) that are countersunk on their upper surface for receiving No. 10 flathead screws for attachment to the hull structure. The front flange 258 of angle section 210 is provided with two rivet holes 260, 262 for attachment of bottom track rail 202 thereto.

Figure 31:
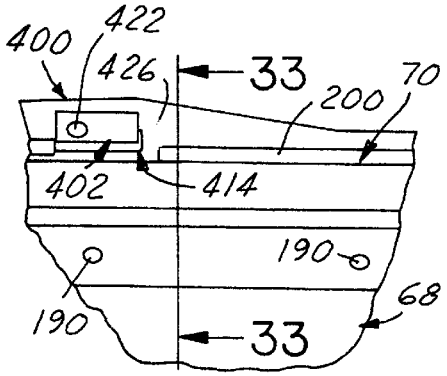
FIGS. 31 and 32 are fragmentary perspective photo views respectively illustrating the improved door-open stop latch in retracted and extended door-open latch positions, along with the associated upper portions of the upper rail, upper door slide and door panel.
Figure 32:
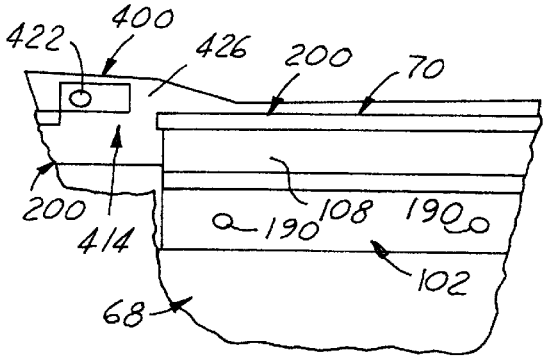

In assembly with port and starboard uprights 204 and 206, bottom frame section 210 is butt welded at its ends to the facing surfaces of the uprights 204 and 206 with flange 258 facing aft and oriented in a vertical plane and flange 250 oriented horizontally and protruding forward to be rested on and attached to the associated boat hull mounting structure. The upper horizontal frame section 208 is likewise butt welded at its opposite ends to the facing flanges of uprights 204 and 206. However, the channel section orientation is reversed from that of lower section 210 in that flange 250 is oriented generally vertically and flange 258 oriented horizontally for mounting of upper rail 70 thereon as shown in FIGS. 6, 7 and 31.

Track Rails

Upper and lower track rails 200 and 202 of the frame/rail sub-assembly of door system 60 are best seen in FIGS. 13, 17, 21, 22, 33, as well as in the assembly views of FIGS. 6–9. Rails 200, 202 are identical to one another and comprise an aluminum extrusion of constant cross sectional configuration that are provided with either a polyester powder coat, preferably a white coating, or a clear anodized coating. In the exemplary installation embodiment illustrated herein, with a door-slide-to-starboard-opening arrangement, the rails are mounted on frame weldment 64 with their port ends flush with the port outboard side of the frame. The rails protrude to starboard beyond the frame sufficiently to provide track length for the door to clear all of the companionway openings 66 when slid to starboard.

Figure 21:
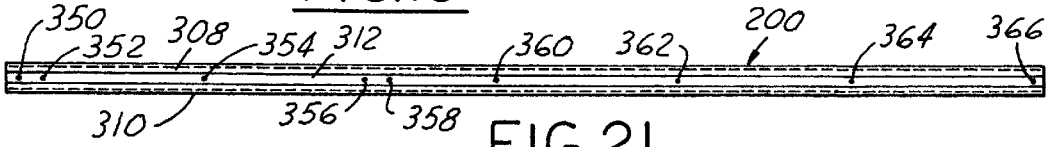
Figure 22:
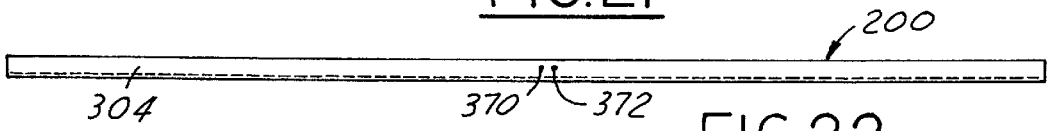

As best seen in the enlarged view of FIG. 13, the cross sectional configuration of each track rail 200, 202 is generally rectangular with a base wall 300, a pair of parallel side walls 302 and 304 and a front wall 306 made up of two lip wall portions 308 and 310 that protrude toward one another from side walls 302 and 304, respectively. Lip walls 308 and 310 define a longitudinally extending central slot opening 312 therebetween that extends the full length of the rail and is open at the longitudinal ends of the rails (FIGS. 20–22).

In accordance with another one of the principal features of the invention, the interior configuration of rails 200, 202 includes two internal shoulder portions 314 and 316 provided at the corner junctions of base wall 300 with side walls 302 and 304, respectively. Shoulder 314 defines in conjunction with the interior surface of side wall 302 and the interior surface of lip wall 306 a full length internal groove 318. Likewise internal shoulder 316 in conjunction with the internal surface of side wall 304 and internal surface of lip wall 310 defines a laterally opposite, symmetrically configured internal groove 320. The two internal shoulders 314, 316 in conjunction with the internal surface of base wall 300 define a third groove 322 that, like grooves 318 and 320, extends the full length of the track rail channel and is open at the longitudinally opposite ends thereof.

The interior surfaces of shoulders 314 and 316 and lip walls 308 and 310 are curved in the plane of the drawing of FIG. 13 to define four curved (in cross section) slide bearing surfaces 324, 326, 328, 330 contiguous with an imaginary cylinder 332 shown in phantom in FIG. 13. It will be seen that the radius dimension of cylinder 332 is less than the distance between the axis 334 of the cylinder and each of the back walls 319, 321 and 323 of grooves 318, 320 and 332, respectively. Preferably the difference in these dimensions is 0.227 inches when base wall 300 has a transverse width dimension of 1.160 and side walls 302 and 304 have a transverse width dimension of 0.870 inches.

As will be seen in FIG. 13, the four bearing surfaces 324–330 thus form an interrupted cylindrical bearing surface for slidably and rotatably receiving the two sets of opposed pair of glides 104 and 106 as mounted on carrier 124. It will be seen that the inclined corner surfaces 170 of glides 104 and 106 slidably bear respectively on curved track surfaces 326 and 324. Likewise, inclined glide corner surfaces 172 of glides 104 and 106, respectively, slidably bear on curved track surfaces 328 and 330. The diagonal distance between inclined corner surfaces 170 and 172 of glides 104 and 106 when assembled on carrier 124 is made just slightly less than the diameter of imaginary cylinder 332 so that the glides of slide 100 can be inserted endwise with a close sliding fit into the open end of the associated rail 200, 202 in initial assembly.

It also will be seen that the minimum spacing distance between lip walls 308 and 310 defining slot 312 is greater than the thickness of slide leg wall 112 protruding therebetween. Hence, with lip walls 308 and 310 serving as pivoting end limit stops, slide 100 can rotate about the axis 334 through a limited angular range of 20 degrees clockwise and 20 degrees counterclockwise from the centered position of slide 100 in rail 202 shown in FIG. 13. Within this predetermined limited slide pivotal range, the inclined corners 170 and 172 of glides 104 and 106 remain in bearing contact with at least a portion of their associated curved slide track surfaces 324–330.

Each of the rails 200, 202 also is formed with a pair of external grooves 340 and 342 each having a keyhole cross sectional configuration and that extend the full length of the rail and are open at their longitudinally opposite ends. Grooves 340 and 342 thus reduce the material contact of shoulder portions 314 and 316 to thereby reduce weight and costs. In addition, the circular portion of the keyhole shape of each groove 340, 342 provides a socket for threadably receiving a self-threading metal screw (not shown), two of which are used to mount an end stop plate 344 (FIG. 6) to the starboard end of lower rail 202. Stop plate 344 is preferably provided with notches or other suitable openings, one in alignment with each groove 318, 320, 322 of rail 202 to permit water drainage of the starboard end of the rail when the boat is heeled to starboard.

For the illustrated embodiment of door system 600, wherein both of the rails 200 and 202 are to be mounted by fasteners extending through their base wall 300, a series of rivet fastener holes 350, 352, 354, 356, 358, 360, 362, 364 and 366 are provided in rails 200 and 202 in base wall 300 aligned centrally with groove 322 (FIG. 21). When lower rail 202 is mounted over frame section 210, the same is flipped over from its orientation in FIGS. 21 and 22 SO that mounting hole 366 is at the extreme port end of rail 202 as viewed in FIG. 6. It will be seen that mounting holes 366, 364, 362 and 360 align with frame weldment mounting holes 270, 272, 276 (FIG. 27), whereas the remaining mounting holes 350–358 are used for receiving mounting fasteners to support the portion of rail 202 extending beyond the starboard side of the frame weldment 64 for attaching directly to the boat structure.

Upper rail 200 is mounted as shown in FIG. 33 with base wall 300 resting upon the horizontal flange 258 of upper frame section 208, the rail mounting holes 362 and 364 being aligned with mounting holes 260 and 262 in upper frame section 208 and rail mounting holes 360 and 366 being aligned with the frame mounting holes 260 in the upper ends of the starboard and port frame uprights 206 and 204. Again, the mounting openings 350–358 are used for mounting fasteners for attachment directly to the boat hull structure to support the portion of upper rail 200 extending to starboard of frame weldment 64.

Open-Position Door Stop

As shown in FIGS. 6, 7 and 31–40, door system 60 also features a built-in stop for holding the sliding door in fully open position. This open door stop function is performed by a door stop sub-assembly 400 mounted to the forward-oriented side wall 304 of rail 200, utilizing a pair of mounting holes 370 and 372 (FIG. 22) provided in rail wall 304 of only the upper rail. Stop assembly 400 comprises a L-shaped mounting bracket 402, shown by itself in FIGS. 38–40, having its wider vertical leg 404 provided with two mounting holes 406 and 408 aligned with mounting holes 372 and 370 of rail 202 and receiving fastening rivets therethrough (not shown). The narrower upper leg 410 of bracket 402 is spaced above and overhangs wall lip 310 of rail 200 (FIG. 33), and is provided with a rivet mounting hole 412. The other primary component of stop assembly 400 is a stop lever 414 shown in assembly in FIGS. 30–34 and by itself in FIGS. 35–37. Door stop lever 414 is also an L-shaped member having a long leg 416 provided with a rivet hole 418 near one end and at the other end an upright stop arm 420. Stop lever 414 is secured to bracket 402 by a rivet 422 (FIGS. 31, 32 and 34) which also serves as a pivot journal for stop arm 414. A Belleville spring washer 424 (FIG. 34) is received on rivet 422 so as to be partially stress-compressed between leg 416 of lever 414 and leg 410 of bracket 402.

Figure 34:
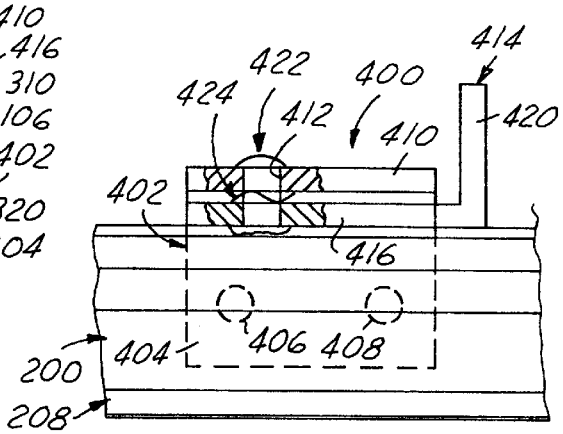
FIG. 34 is a fragmentary elevational CAD view of the door-open latch mechanism and associated portions of the rail and door slide, and enlarged over the view of FIG. 33.
Figure 35:
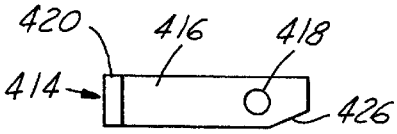
FIGS. 35, 36 and 37 are respectively plan, end elevational and side elevational CAD views of the door stop lever shown by itself.
Figure 38:
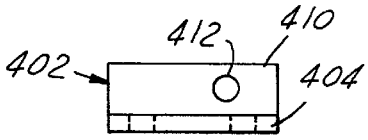
FIGS. 38, 39 and 40 are respectively bottom plan, end elevational and side elevational CAD views of the door stop bracket of the latch construction of FIGS. 31–34, shown by itself.
Figure 36:
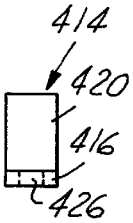
Figure 37:
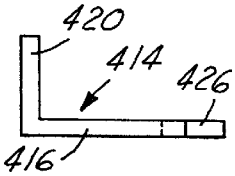
Figure 39:
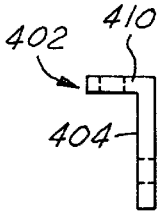
Figure 40:
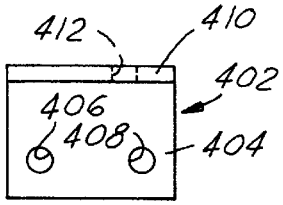

Lever 414 is shown in its retracted position in solid lines in FIGS. 33 and 34, and in perspective in FIG. 31. Lever 414 can be pivoted in the direction of the arrow in FIG. 33 through approximately a 20 degree swing range out to a holding position for edge abutment-stopping of closing motion of the sliding door from its fully open position. The end limit of this pivotal motion is set by an angled corner surface 426 of lever 414 that abuts the aft-facing surface of portion 404 of bracket 402 when arm 414 is swung aft from its retracted position to the stop position shown in FIG. 32. In this position, the stop arm 420 is thus positioned as an obstruction in the travel path of the bight portion 108 of slide extrusion 100 of upper slide/cap assembly 70. The yieldable frictional resistance exerted between washer 424 and the relatively movable surfaces of legs 410 and 416 is sufficient to stabilize the door stop arm in either its door-release or door-stop positions. Preferably a soft rubber or flexible material bumper sleeve 426 (shown in FIGS. 31 and 32) is mounted on arm 420 to cushion the abutment between the stop arm and door slide edge.

Installation. Assembly and Operation of Door System 60

Figure 3:
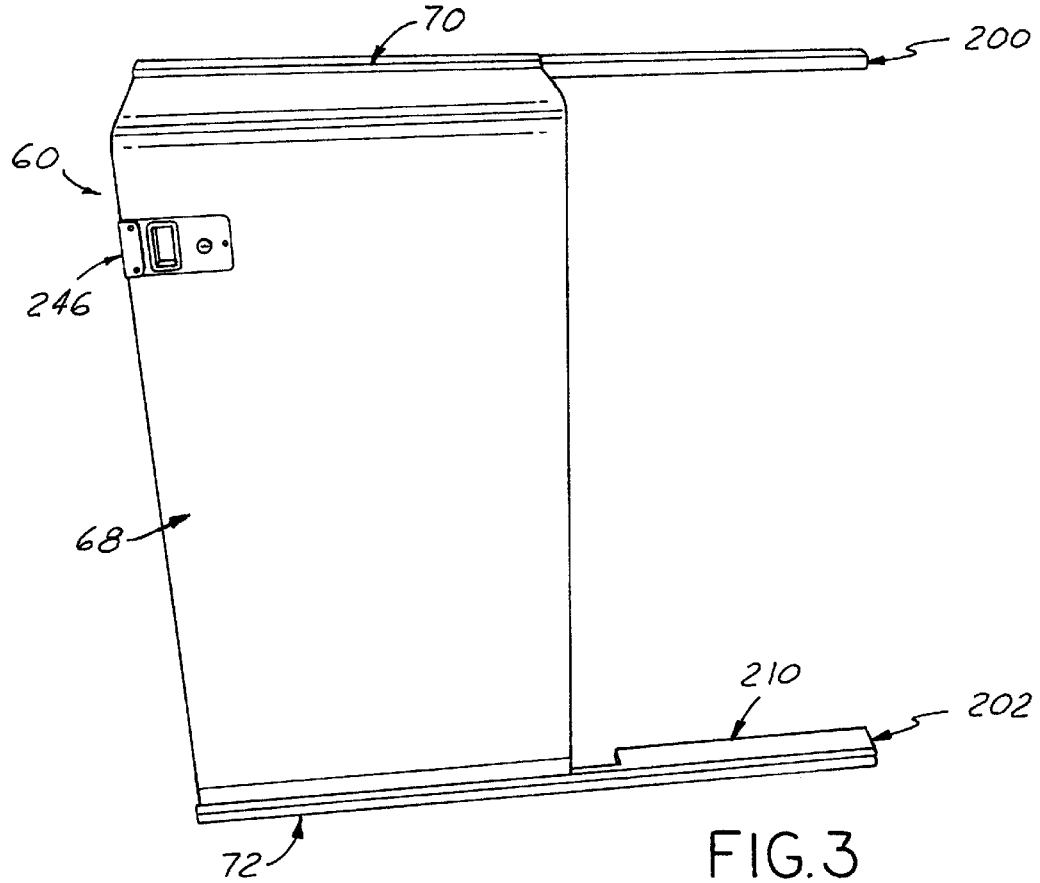
FIG. 3 is a perspective photo view with the door and frame work, again as viewed from the aft side thereof, but with the door in closed position.

Preferably the foregoing construction components of door system 60 are furnished as a complete, ready-to-boat-install product from the door system manufacturer. Hence the door/slide sub-assembly 62 is factory installed on the frame/rail sub-assembly 64/200/202 and is completely operable as a sliding door system prior to boat-mounting. The upper edge of door panel 68 is thus slidably mounted by upper slide and cap sub-assembly 70 in upper rail 200, and likewise the lower edge of door panel 68 is slidably mounted by the lower slide/cap sub-assembly 72 in lower rail 202. This is done during door manufacture by endwise installation of the slide mounted glides 104, 106 into the associated upper track rail as shown in FIGS. 13 and 33, and prior to mounting end stop 344 on the starboard end of lower rail 202. The strike plate 246 on port frame upright 204 limits sliding motion of the door to port by abutment of handle 92 with the strike plate latch (FIG. 3). The door may be latched and locked in closed position utilizing the commercially available latch hardware 92 and associated cooperative latch and strike plate 246. When the operating handle of latch 92 is released, door panel 68 may be easily slid to starboard from its closed position of FIG. 3, through its partially open position of FIGS. 4 and 5, to its more fully open position of FIGS. 1 and 2 and finally to a fully open position wherein the port edge of the door panel aligns generally flush with the port edge of starboard upright 206 of frame weldment 64.

Second Embodiment Slide/Cap Sub-Assembly

Figure 41:
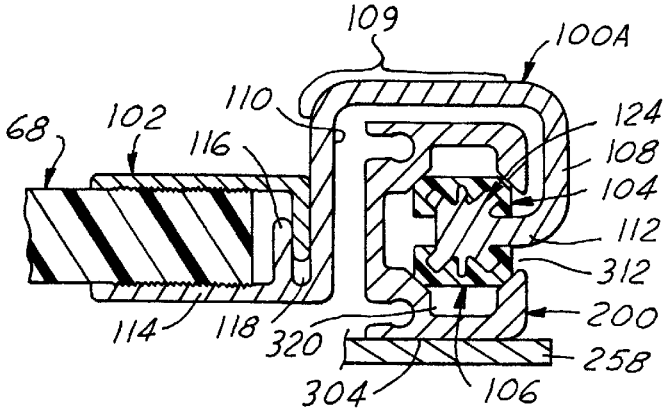
FIG. 41 is a cross sectional CAD view similar to that of FIG. 33 but illustrating a modified upper door panel slide extrusion to accommodate a mounting of the upper track rail with the slide slot facing forward.

FIG. 41 illustrates how upper rail 200 also may be mounted, like lower rail 202, with slot 312 facing forward of the water craft. Firstly, to achieve this orientation, rail 200 is merely rotationally re-oriented 90 degrees about its longitudinal axis from the FIG. 33 orientation so that side wall 304 is facing downwardly and resting on frame flange 258. Mounting fasteners are inserted through the mounting openings provided in groove 320, which now becomes the bottommost groove of channel 200 in this orientation.

Secondly, as shown in FIG. 41, in order to accommodate this slot-forward rail mounting, a modified main slide member 100A is provided which structurally is the same as slide 100 except that a right-angle wall extension portion 109 is provided integrally between bight wall 108 and leg wall 110 that overlies rail 200 in assembly therewith. Main slide 100A thus positions door panel 68 with its upper edge clamped between leg wall 114 and cap 102 in the same orientation that it is held by slide 100 in FIG. 33. With the modified slide 100A, greater weather sealing labyrinth protection is afforded when the door is closed, and less dirt tends to be entrained within the track rail 200 when oriented as shown in FIG. 41.

Third Embodiment Slide/Cap Sub-Assembly

Figure 42:
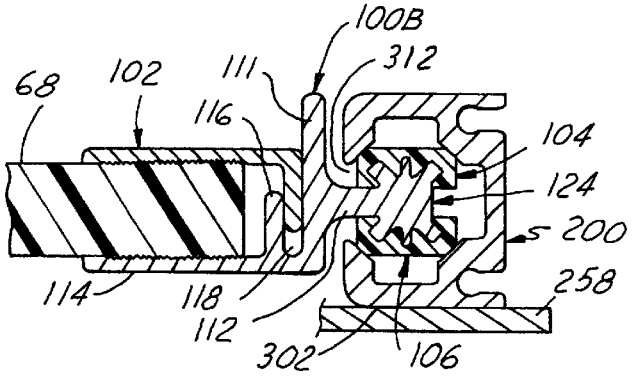
FIG. 42 is a cross sectional CAD view, also similar to that of FIG. 33 but showing a second modification of the upper main slide extrusion to accommodate a mounting of the upper track rail with the slot facing aft.

Referring to FIG. 42, if it is desired to mount upper rail 200 with slot 312 facing aft of the water craft, a second embodiment main slide extrusion 100B may be utilized. In this embodiment, the leg wall 112 extending from the ribbed carrier 124 protrudes out through the rail slot 312 and then is directly joined perpendicularly to a ledge wall portion 111 (that replaces portion 110 of slide 100) as shown in FIG. 42. Again, it will be seen that cap 102 cooperates with ledge wall 111 and keeper wall 116 to be slidably captured in the slot 118 formed therebetween. Also, it will be seen that upper edge of panel 68 is positioned dimensionally relative to rail 200 substantially as it is held in the rail orientation of FIG. 33 by main slide 100, or as held in the rail orientation shown in FIG. 41 using main slide member 100A.

Figure 43:
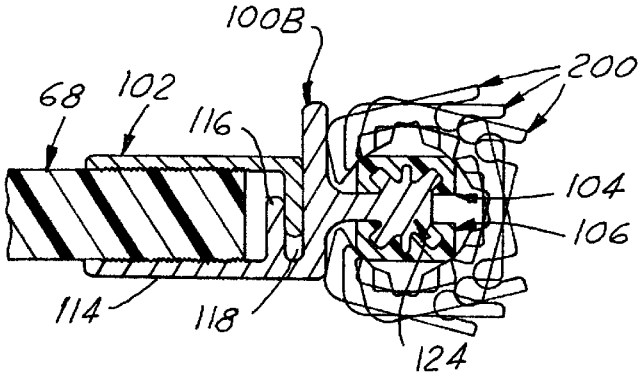
FIG. 43 is a view corresponding to FIG. 42 but illustrating the permissible angular range of twist relative rotation of the upper track rail without thereby binding the sliding motion of the slide in the rail.

FIG. 43 illustrates, utilizing main slide 100B by way of example, the range of relative rotation about the center longitudinal axis of carrier 124 that can be imparted to rail 200 without interfering with or binding of sliding motion of the door panel in the track rail.

Modified Slide Glide Carrier and Modified Glide Structure

Figure 44:
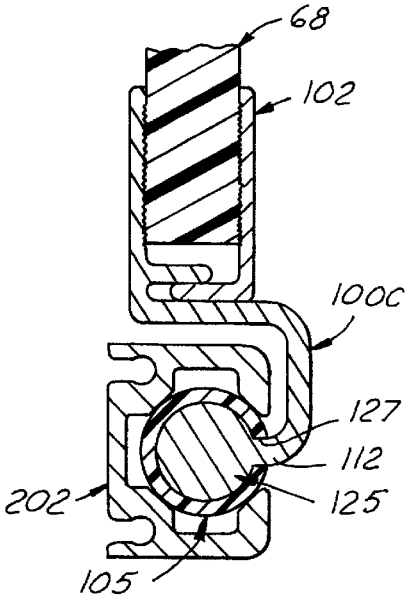
FIG. 44 is another cross sectional view similar to that of FIG. 13 but illustrating a third modification of the main slide extrusion also in accordance with the invention.

FIG. 44 illustrates a modified main slide member 100C which is constructed as an extrusion in the manner of slide 100 but with a modified carrier portion 125 substituted for the ribbed carrier portion 124, and with a modified pair of glides 105 (spaced longitudinally apart from one another on carrier 125) substituted for the two sets of glide pairs 104 and 106 of the first embodiment glide construction. Thus, as will be seen in FIG. 44, carrier is cylindrical in cross section, being shown as a solid cylinder but it may also be made as a hollow tubular section at more expense in extrusion die cost to achieve a saving in material cost and weight.

The construction of glide 105 is that of a circumferentially split sleeve having a parting gap 127 that accommodates the leg wall 112 protruding therethrough. A pair of such split sleeves 105 are positioned on carrier 125 longitudinally thereof adjacent the opposite longitudinal ends in the manner of the glide pairs 104, 106 described previously.

The outer diameter of sleeve 105 is designed with a slight sliding clearance fit on the track surfaces 324–330 to permit longitudinal sliding of the door panel therealong as well as the aforementioned limited range of relative rotation between slide 100C and track 202. Each of the two sleeves 105 may be held against movement longitudinally relative to carrier portion 124 of slide 100C by forming four retaining detents, one flanking each side of each glide 105, as by a chisel upset formed in the surface of carrier 125 after installation of glide 105 to the desired position longitudinally of carrier 125. Each of the glides 105 may be made of the same semi-resilient plastic material as glides 104/106 and hence may be removed sideways by the parting gap swinging open as the glide is pulled laterally off of carrier 125, and vice-versa relative to installation of replacement glides 105 as a field service operation.

Features and Advantages of Door System 60

From the foregoing description, it will now be apparent to those skilled in the art that the sliding companionway door system 60 of the invention in its several embodiments amply fulfills the aforestated objects and provides many features and advantages over the prior art. The two-piece aluminum extrusion slide/cap assemblies 70 and 72 removably fastened on the top and bottom edges of the door panel 68 provide a very tight weather seal at these door panel edges, and also stiffen the top and bottom of the door panel. This as well as the other various features of door system 60 are provided as an integral part of an entire frame and door assembly such that a complete door system is provided that minimizes labor and installation costs and related problems for the boat builder. For example, the end stops 344 and 246 that define the extreme end travel limits of the door are built into the system and need not be installed to the boat structure. The open door stop assembly 400 is likewise attached solely to the frame and rail sub-assembly and thus need not be installed on the boat hull structure. Moreover, the door stop 400 more reliably maintains its operational relationship with the door because of its mounting in the door and frame system rather than independently of the boat hull structure. All of the weather sealing structure is also built into the frame and door system, and all of the mounting holes are provided in the system as supplied to the boat builder.

The unique mounting of the door panel slides on glides 104, 106 which slide along on "elevated" track surfaces 326–330 offers many advantages. This design allows rotational freedom around the sliding axis 334 SO that either or both the upper and lower the slide/cap assemblies 70 and/or 72 can rotate about the bearing axis 334 for at least 20 degrees either side of a centered position. Thus, if either the slide 70 and/or 72 or rails 200 and/or 202 are twisted during installation, this rotational freedom will compensate for either type of twisting without introducing binding of, or during, sliding travel. Twisting of the rails to conform to non-parallel or uneven hull structure surfaces to which they may be mounted thus can be readily compensated for by the door system of the invention. The use of longitudinally short glides attached one to either end of the slide carrier 124 or 125 minimizes the amount of bearing material that is used. Rotational freedom despite track twist or bending is also enhanced by these glides being small in length longitudinally or axially and located at the ends of the carrier 124. The side or lateral clearance thus provided between carrier 124, 125 and track bearing surfaces 324–330 by the radial spacing therebetween provided by the pair of glides at the opposite ends of the carrier enables non-bending sliding travel around bend curves in the rail. This as well as the rotational freedom also will assist the door system to accommodate non-parallel mounting of the upper and lower rails 200 and 202 without binding the door during sliding motion. This feature is particularly advantageous if the door panel 68 is made of semi-flexible, semi-resilient plastic material so as to readily accommodate changes in its shape during door slide travel and the distortion caused by the non-parallelism of the slide surfaces of the two rails. The novel slide rails 200 and 202 have a cross section design that facilitates their installation and which is sufficiently compact to fit into a narrow recessed rain gutter in some boat installations. The three longitudinal inner or internal grooves 318, 320 and 322 in each rail provide room for receiving the heads of mounting fasteners without interfering with glide travel. These internal grooves also provide room for dirt to collect in whichever groove is oriented lowermost in a given installation rather than having the dirt trapped on the bearing surfaces. As seen by comparing FIGS. 13 and 33 with the rail mountings of FIGS. 41 and 42, each rail can be selectively mounted with the exterior bottom mounting surface being either that of base wall 300 or either of the side walls 302 and 304 due to the triple groove internal configuration.

The slides and the cooperative rails are reversible so that left or right hand mounting is readily feasible. The longitudinal external grooves 340 and 342 in each rail provide weight and material savings and, as an added benefit, provide screw bosses in the ends of the rails to thereby serve as a strong and inexpensive mounting structure for one or more end stops fastened to either or both ends of the rails. Thus, end stops or resilient bumpers can be built into the rails and do not have to be installed at the boat builders manufacturing facility. These screw bosses can also be used for mounting to boat frames or other side attachment structure of the boat hull.

As another important feature, the slide and rail cross sectional geometry in all embodiments form an improved labyrinth seal to seal out rain and wave water, as well as wind, at the top and bottom edges of the door when in closed position. The fact that the slide carrier 124 or 125 is carried relatively deeply in the interior of the track rail, and that it is enlarged diametrically in the interior space, enhances the labyrinth sealing action. The support of the slide on "elevated" track surfaces provides a drainage trench below the glides and glide carrier so that water can readily drain endwise out of the track rail, as well as laterally back out through slot opening 312 over the lower leg wall 310 when rails 200, 202 are mounted as in FIGS. 13, 41 or 42. Since the slide glide bearing surfaces 324–330 of the track rail are all internal, they are protected from dirt, foot traffic and damage from being struck by hard objects on the boat.

The novel slide/cap sub-assembly 70 and 72 also provides several features and advantages over the prior art. These slide/cap assemblies cover the upper and lower edges of the acrylic material of door panel 68, thereby eliminating the need for expensive polishing of these machine-cut surfaces. In the embodiment utilizing the ribbed glide carrier 124, the glides 104 and 106 are attached to fingers angled at 45 degrees and they mate with the rail bearing surfaces also at 45 degree angles. This allows the door system to slide without binding despite applied loads that are not vertical nor horizontal. This is also true of carrier 125 and sleeve glides 105 of FIG. 44. This is important because companionway doors often need to be formed with a bend at approximately 90 degrees in their cross sectional shape as with door panel 68. This creates an off-plane force when the door is slid which, in turn, means that the bearing surfaces are being both pushed and pulled by sliding or door manipulating forces. Thus, on the top door rail 200, a force is applied during sliding producing a vector resultant that is in both vertical and horizontal planes.

Moreover, by having rotational freedom of the door slides on the rail bearing surfaces, these compound and off-plane applied forces are exerted primarily in compression or tension on the door panel edges, rather than inducing bending stresses near the edges of the door that cause fatigue cracks or fracture when exceeding the stress limits of the material. Hence, in addition to this slide/rail mounting feature enhancing freedom of door sliding motion under adverse mounting and environmental conditions, door life is increased and new appearance preserved.

The 45 degree angulation of the track bearing surfaces of the rails also helps to shed dirt from these surfaces, and the short glides 104 and 106, or the short glides 105, also operate as scrapers during door travel to provide self-cleaning action by scraping dirt off the track bearing surfaces into the dirt collecting trenches of the rail. The small ribs 136, 138 of ribbed carrier 124 provide an easily deformed portion of the extrusion for providing travel limit stakes for each of the glides.

The two-piece slide assembly, consisting of the main slide 100 and the cap 102, is formed from two economical extrusions that cooperate to provide a variable-width groove to securely clamp various thicknesses of the associated edge of the door panel. The serrated surfaces 122 and 124 grip the acrylic material of the door in a secure and watertight manner. The edge lip 120 on slide 100 and the similar lip 146 on cap 102 further enhance the water seal gripping action of the slide/cap assembly. This two-piece assembly also allows the acrylic door panel 68 to be removed from its mounting in the boat and easily replaced if necessary.

This two-piece slide/cap design also allows different thicknesses of acrylic material to be utilized in the door system. For example, a range of thicknesses from ⅜ inches to ¾ inches in acrylic material can be used in this system. This adjustability also readily accommodates the considerable tolerance variation in the thickness dimension of acrylic material used in fabrication of doors. For example, the commercial tolerance for a nominally ½ inch thick acrylic panel is as large as 0.125 inches.

The door stop assembly 400 is also built into the door system and thus is not dependent on providing an appropriate location on the boat hull structure. The door stop is readily manipulated by hand and is reliably held in door stop or retracted positions by the friction of the Belleville spring washer 424. This is a simple, durable assembly that well performs this function and is easier for the boat operator to use than prior art stop systems presently provided for sliding doors on boats.

Although grooved glides 104, 106, or split sleeve guides 105 that are fixed on the glide carrier against rotation relative thereto are preferred, it is also possible to utilize certain features of the invention to advantage while still substituting rollers or balls for the glides while still maintaining the track rail configuration internally. However, sliding glides are less expensive and are therefore preferred.

It will also be understood that the sliding door system of the invention in many of its features and advantages will find advantageous uses in different applications other than marine water craft, such as in shower doors, refrigeration case doors, or other types of sliding doors that need weather resistance and ability to accommodate adverse mounting angles and surfaces while maintaining freedom of sliding motion and weather tight characteristics in closed condition.

Moreover, from the foregoing it will now be apparent to those skilled in the art, that in many applications the frame weldment 64 can be eliminated and the rails 200 and 202 mounted directly to the boat hull and/or deck structure while still retaining most of the foregoing features and advantages of the sliding door system of the invention.

What is claimed is:

1. A sliding door assembly adapted for opening and closing a doorway in an enclosed structure having walls defining the doorway, said door assembly comprising:

(a) upper and lower track C-channel rails (200 and 202), each having a hollow interior cross-sectional configuration defining a longitudinally extending hollow interior slideway (324, 326, 328, 330) having a circumferentially interrupted cylindrical slide bearing surface and wherein each said rail is adapted to be supported on a wall of the structure with a major longitudinal axis of each rail extending generally horizontally, each said rail having a longitudinally extending slot opening laterally (312) to the hollow interior slideway of said rail, (b) a door panel (68) sized to be adapted to close the doorway and having upper and lower edges juxtaposed to said upper and lower track channels and being made of a material having at least limited flexibility, (c) an upper slide and cap panel-attachment sub-assembly (70) and a lower slide and cap panel-attachment sub-assembly (72) each having an panel attachment structure_secured to said door panel upper and lower edges, and extending substantially the full length of the associated said panel edges, (d) each said sub-assembly having a first leg wall (112) extending therefrom into the hollow interior slideway of the associated one of said rails via said rail slot opening and terminating therein in a glide carrier portion (124 or 125), and (e) each said sub-assembly also including a pair of glides (104 or 105) mounted on said sub-assembly first leg wall of said glide carrier portion (124 or 125) with said glides of each said pair being spaced longitudinally of said carrier portion and respectively located adjacent the longitudinally opposite ends of the associated said carrier portion and having a slide bearing surface bearing slidably on said slide bearing surface of said slideway of the associated said rail for slidably supporting said door panel by sliding motion of said slides along the longitudinal axis of said track rail slideway, said rail and glide slide bearing surfaces being curved complementally to one another, and said rail slide bearing surface being cylindrically curved throughout its circumferential extent about a single radius of cylindrical curvature centerline extending parallel to said major longitudinal axis of said rail such that each said door slide and cap sub-assembly has limited rotational freedom around the rail slide bearing cylindrical surface sliding axis that permits a limited range of relative rotation only about such centerline axis between each said door slide and cap sub-assembly and associated rail so that, if either said sub-assembly or rail is twisted during installation or operation, such rotational freedom will compensate for either such twist, thereby enabling said door assembly to be mounted with said rails allowed to twist within certain limits when fastened down to conform to non-parallel or non-level structural surfaces to which they are mounted either as manufactured or as distorted in operation by loading causing structural twisting without thereby inhibiting sliding motion of said door along said rails.

2. The door assembly of claim 1 wherein said slide and cap panel-attachment sub-assembly of each said door slide and cap assembly is constructed and arranged to have an adjustable clamping structure secured to their respectively associated door panel upper and lower edges by clamping thereto.

3. The door assembly of claim 2 wherein each said slide and cap subassembly includes a main slide (100) formed as an aluminum extrusion of constant cross sectional configuration and extending lengthwise substantially the full width of said door panel (68), said main slide (100) having a U-shaped channel section made up of a central bight wall (108) integrally joined through radiused corners to a second leg wall (110) and to said first leg wall (112) that extend parallel to one another, an outer edge of said second leg wall (110) being joined through a radiused corner to a panel clamp leg wall (114) that extends with its major plane generally perpendicular to that of said second leg wall (110) and generally parallel to that of said bight wall (108), said main slide also having a keeper leg wall (116) protruding from said clamp leg wall (114) adjacent said second leg wall (110) and being spaced therefrom to define a slide cap keeper slot (118) therebetween, said clamp leg wall (114) having a upper door panel facing longitudinal edge provided with a small radius protruding lip (120) and a door panel facing surface provided with a row of longitudinally extending teeth (122) for sealably clamping against the associated clamped surface of said door panel.

4. The door assembly of claim 3 wherein said first leg wall (112) of said slide (100) terminates at its free end in said glide carrier portion (124), said glide carrier portion being formed as a terminal integral enlargement of said first leg wall (112) and having four longitudinally extending and radially protruding major or thick ribs (126, 128, 130, 132), each having its major mid-plane oriented at an included angle of about 45 degrees relative to the mid-plane (134) of said first leg wall (112) such that said ribs (126–132) thus form diametrically oppositely protruding major rib pairs (126/130 and 128/132), said glide carrier portion also having a pair of minor or thin ribs(136 and 138) formed co-planar with their major plane perpendicular to said first leg wall mid-plane (134) so as to protrude respectively between said first major ribs (126 and 128) and between second major ribs (130 and 132), and wherein the outer end edges of said major ribs (126–132) are edge-rounded and terminate flush with an imaginary circle (140) and wherein the outer end edges of said thin ribs (136 and 138) terminate slightly short of said circle (140), each of said glides (104, 106) being grooved to receive one of said thin ribs and the two of said major ribs flanking said one thin rib, the exterior surface of each said glide being contoured by being curved about said radius of curvature for slidably bearing on said slideway for both said limited relative sliding rotation and longitudinal sliding motion therealong.

5. The door assembly of claim 4 wherein each said glide (104, 106) is rectangular in plan view with flat parallel opposite side surfaces (160, 162), flat and parallel end faces (164, 166), a flat top surface (168) and oppositely inclined track-engaging slide surfaces (170 and 172) intersecting the respectively associated end surfaces (164 and 166) at about a 45 degree angle, and wherein each said glide (104, 106) is formed with oppositely angled major grooves (174 and 176) complementary in configuration to said carrier major ribs (126 and 128) and ribs (132 and 130) and a central minor groove (178) complemental to said carrier minor thin ribs (136 or 138), each said glide (104, 106) being made of a plastic material to render the same semi-resilient, and wherein the material removed in the formation of said grooves (174–178) thus enables yieldable bending of each glide in a plane perpendicular to said slideway longitudinal axis to thereby widen a gap defined between a pair of rounded edges (180 and 182) of associated re-entrant gripping fingers (181 and 183) formed in a bottom side of each said glide (104, 106) by the provision of said major grooves (174 and 176).

6. The door assembly of claim 5 wherein each said glide (104, 106) is assembled onto said glide carrier portion (124) during manufacture by being oriented adjacent a longitudinal end of said carrier portion with its said grooves (174, 176 and 178) aligned with said ribs (126, 128 and 136) or ribs (130 and 132 and 138) and then slid sideways onto these ribs to a position inward from the associated end of said carrier portion (124) and then, in order to capture each said glide within a limited range of sliding motion longitudinally of said carrier portion (124), the associated one of said minor or thin ribs (136, 138) is struck out slightly to produce two limit stop tangs, one on either side of each said glide (104, 106).

7. The door assembly of claim 6 wherein said glides comprise two upper glides (104) and two identical lower glides (106) mounted on each said slide/cap sub-assembly (70, 72) and said glides are identical with one another and are each extruded from a suitable length of material having a cross-sectional configuration defining said grooves as extruded and from which said individual glides (104, 106) are cut at equal length increments.

8. The door assembly of claim 7 wherein said glide plastic material comprises a polymer filled with a self-lubricating material.

9. The door assembly of claim 8 wherein said glide plastic material is a filled acetal plastic material.

10. The door assembly of claim 6 wherein once said glides have been constrained as set forth in claim 6 for limited longitudinal travel on said carrier (124), said glides still may be individually removed and replaced by peeling off each said glide due to its semi-resilient characteristics and configuration thereby permitting yieldable bending of said glide in a said plane perpendicular to the longitudinal axis of said carrier (124), and wherein re-installation, or installation of replacement glides, between said travel-limiting strike outs in the center ribs may be accomplished manually as assisted by a suitable hand tool such as pliers or a screwdriver to apply sufficient mounting distortion forces to snap each said glide onto seated position on said associated mounting ribs.

11. The door assembly of claim 3 wherein each said slide and cap sub-assembly includes a slide cap (102) that is L-shaped in transverse cross section to have wide and narrow leg walls (144, 142) and is co-extensive in length with said main slide (100) and is likewise formed as an aluminum extrusion of constant cross-sectional configuration with said narrow width leg wall (142) designed to slip fit into said keeper slot (118) of said slide (100) so as to be adjustably captured between said second leg wall and said keeper leg wall (116) of said slide (100) in panel-clamping assembly therewith.

12. The door assembly of claim 11 wherein said upper rail (200) is adapted to be mounted with said central slot (312) facing outward and generally co-planar with the adjacent portion of said door panel such that a bottom wall (300) of said rail wall is adapted to face outwardly away from the adjacent portion of said door panel and a side wall (304) is adapted to face toward the door assembly supporting structure of said enclosed structure and mounting openings are provided in said side wall (304) in an internal groove (320) provided therein which now becomes the bottom most groove of said rail in this orientation, and wherein said main slide (100A) has a right-angle wall extension portion (109) provided integrally between a bight wall (108) and a leg wall (110) that overlies said rail (200) in assembly therewith.

13. The door assembly of claim 11 wherein said upper rail (200) is adapted to be mounted with said slot (312) facing toward the adjacent portion of said door panel and said main slide (100B) has said leg wall (112) extending from said glide carrier (124) so as to protrude out through said rail slot (312) and then is directly joined perpendicularly to a ledge wall portion (111), and wherein said cap (102) cooperates with said ledge wall (111) and said keeper wall (116) is slidably captured in said keeper slot (118) formed therebetween.

14. The door assembly of claim 11 wherein said cap wider leg wall (144) is formed with its major plane defining an included angle slightly less than 90 degrees relative to the major plane of said cap narrow leg wall (142), and wherein said cap (102) in panel-clamping assembly with said slide (100) is oriented with its upper end generally flush with that of said slide (100), and wherein said cap 102 also has a longitudinal rib (146) at its upper edge, facing said slide rib (120), and a row of longitudinally extending teeth (148) facing said slide teeth (122).

15. The door assembly of claim 14 wherein a plurality of fastener-receiving mounting holes (150, 152, 154 and 156) are provided in each said slide (100) for alignment with corresponding mounting holes (76, 78) in said door panel, and wherein each said cap (102) is likewise provided with a plurality of mounting holes-oriented identically with said slide mounting holes (150–156) for axial alignment therewith in panel-clamping assembly, and wherein said door panel mounting holes are oblong in configuration with the major hole axis extending perpendicular to said rails to permit mounting adjustment of said door panel in said slide and cap sub-assemblies.

16. The door assembly of claim 15 wherein the door panel mounting adjustment is fixed by insertion of an adhesive sealant in said door panel mounting holes after final clamping-tightening of associated fasteners therein.

17. The door assembly of claim 15 wherein, to complete the assembly of said door with each said slide and cap sub-assemblies, the lower edge said door panel (68) is inserted between said clamp leg wall (114) of said main slide (100) and said cap wider leg wall (144) of said cap (102), suitable fasteners (190) are inserted through said mounting holes (150–156) of said slide (100) and door panel (68) oriented to register said door panel mounting holes (78) with the fastener ends so that they protrude through the exterior surface of said door panel (68), and wherein said cap (102) is likewise registered with its mounting holes on protruding fastener ends and then drawn up tight as said fasteners are secured to insert clamping pressure via said clamp leg wall (114) and said cap wider leg wall (144) on the edge portion of the door panel captured therebetween, whereby said serrations (122 and 148) of said slide (100) and said cap (102) function to grip the material of said door panel securely as so installed, whereby said small raised longitudinal lips (120 and 146) further enhance the gripping action of said door panel and form a water seal at the weather side interface of this joint, whereby the inclination angle (B) of said cap wider leg wall (144) in cooperation with the close sliding fit of said leg wall (142) into said slide cap keeper slot (118) in assembly causes said lip (146) of said cap (102) to grip more tightly than those of said serrations (148) most remote therefrom to further enhance the water tight seal achieved during this installation.

18. The door assembly of claim 2 wherein said upper and lower track rails (200 and 202) are identical to one another and each comprise an aluminum extrusion of constant cross-sectional configuration that is generally rectangular as defined by a base wall (300), a pair of parallel first and second side walls (302 and 304) and a front wall (306) made up of first and second lip wall portions (308 and 310) that protrude toward one another, one from each of said side walls (302 and 304) such that said lip walls (308 and 310) define said longitudinally extending central slot opening (312) therebetween that extends the full length of each said rail and is open at the longitudinal ends of each said rail.

19. The door assembly of claim 18 wherein said rails are provided with a protective coating of either a polyester powder coat having a white coating, or a clear anodized coating.

20. The door assembly of claim 18 wherein the interior configuration of each of said rails (200, 202) includes first and second internal shoulder portions (314 and 316) provided at the corner junctions of said base wall (300) with said first and second side walls (302 and 304), respectively, said first shoulder portion (314) defining in conjunction with the interior surfaces of said first side wall (302) and the interior surface of said first lip wall (308) a full length first internal groove (318), and wherein said second internal shoulder (316) in conjunction with the internal surface of said second side wall (304), and internal surface of lip wall(310) defines a laterally opposite, symmetrically configured second internal groove (320), and wherein said internal shoulders (314, 316) in conjunction with the internal surface of said base wall (300) define a third internal groove (322) that, like said first and second internal grooves (318 and 320), extends the full length of said track rail channel and is open at the longitudinally opposite ends thereof.

21. The door assembly of claim 20 wherein the interior surfaces of said shoulders (314 and 316) and said lip walls (308 and 310) are curved in a plane perpendicular to the rail longitudinal axis to define four curved, in cross-section, slide bearing surfaces (324, 326, 328, 330) contiguous with an imaginary right cylinder (332) having a radius dimension less than the distance between the axis (334) of said imaginary cylinder and each of first, second and third back walls (319, 321 and 323)of said first, second and third grooves (318, 320 and 332) respectively, said four curved slide bearing surfaces (324–330) thereby being curved about said radius of curvature and thereby forming said interrupted cylindrical bearing surface for slidably and rotatably receiving said glides (104 and 106, or 105) as mounted on said glide carrier portion (124) with surfaces of said glides slidably bearing on said curved track surfaces (326, 324, 328 and 330).

22. The door assembly of claim 21 wherein the outside dimensional distance between said exterior sliding surfaces of said slides (104 and 106) when assembled on said carrier portion (124) is made just slightly less than the diameter of said imaginary cylinder (332) so that said glides can be inserted endwise with a close sliding fit into the open end of the associated said rail (200, 202) in initial assembly.

23. The door assembly of claim 22 wherein the minimum spacing distance between said lip walls (308 and 310) defining said slot (312) is sufficiently greater than the thickness of slide leg wall (112) protruding therebetween such that said lip walls (308 and 310) serve as pivoting end limit stops so that said slide (100) can only rotate about the rail axis (334) through a limited angular range of about 20 degrees clockwise and about 20 degrees counterclockwise from the centered position of said slide (100) in said associated rail (200 and 202) and such that within this predetermined limited slide pivotal range, the sliding bearing of said glides (104 and 106 or 105) remain in bearing contact with at least a portion of their associated said curved slide track surfaces (324–330).

24. The door assembly of claim 23 wherein each of said rails (200, 202) also is formed with a pair of first and second external grooves (340 and 342), each having a circular portion in cross-sectional configuration and that extend the full length of the associated said rail and are open at their longitudinally opposite ends such that said external grooves (340 and 342) respectively reduce the material content of said first and second shoulder portions (314 and 316) to thereby reduce weight and costs, and the circular portion of each said external groove (340, 342) provides a rail end socket for threadably receiving an associated self-threading screw for mounting an end stop plate (344) to said associated rail.

25. The door assembly of claim 24 including in combination therewith said stop plate (344), said stop plate having notches or other suitable openings, one in alignment with each of said internal groove (318, 320, 322) of said associated rail (202), to permit water drainage out the associated end of said rail.

26. The door assembly of claim 1 wherein said door assembly also includes a frame/rail sub-assembly comprising a frame assembly weldment (64) wherein said upper and lower track C-channel rails (200 and 202) are detachably fastened to the upper and lower edges of said frame weldment (64), said frame weldment (64) being composed of first and second upright frame sections (204 and 206) that extend parallel to one another with appropriate lateral spacing therebetween adopted to match the associated enclosed structure walls defining the corresponding first and second side edges of the doorway (66), said uprights (204 and 206) being interconnected at their upper and lower ends by an upper frame section (208) and a lower frame section (210), respectively, and wherein said rails are mounted on said frame weldment (64) with one of their ends flush with said first upright of said frames and wherein said rails protrude beyond said frame second upright sufficiently to provide track length for said door panel to clear all of the doorway opening when slid away from said first upright.

27. The door assembly of claim 1 further including a built-in door stop for holding said sliding door assembly in fully open position, said door stop-sub-assembly (400) being mounted to the in-use outermost-oriented side wall (304) of said one of said rails (200) and comprising an L-shaped mounting bracket (402) having its wider vertical leg (404) fastened to said side wall (304) of said rail (202), the narrower upper leg (410) of said bracket (402) being spaced above and overhanging said wall lip (310) of said rail (200), a door stop lever (414) also comprising an L-shaped member having a long leg, (416) near one end and at the other end an upright stop arm (420), said stop lever long leg (416) being secured to said bracket (402) by a rivet (422) which also serves as a pivot journal for said lever stop arm (414) and a Belleville spring washer (424) received on said rivet (422) so as to be partially stress-compressed between said long leg (416) of said lever (414) and said narrower upper leg (410) of said bracket (402), said bracket and door stop lever being constructed and arranged such that said lever (414) is pivotable through approximately a 20 degree swing range out to a holding position for edge abutment-stopping of closing motion of said sliding door panel from its fully open position, the end limit of this pivotal motion being set by an angled corner surface (426) of said stop lever (414) that abuts the inward-most-facing surface of wider vertical leg (404) of said bracket (402) when said lever arm (414) is swung from a retracted position to a stop position wherein said stop arm (420) is positioned as an obstruction in the travel path of said slide extrusion (100) of said upper slide/cap assembly (70), and wherein the yieldable frictional resistance exerted between said washer (424) and the relatively movable surfaces of said bracket upper leg (410) and said lever long leg (416) is sufficient to stabilize said door stop in either its door-release or door-stop positions.

28. The door assembly of claim 1 wherein said main slide (100C) is constructed and arranged with said carrier portion (125) being cylindrical in cross section, and wherein said glides (105) each comprise a circumferentially split sleeve having a parting gap (127) that accommodates said leg wall (112) protruding therethrough, and wherein a pair of such split sleeves (105) are positioned on said carrier (125) longitudinally thereof adjacent its opposite longitudinal ends, the outer diameter of each said sleeve (105) having a slight sliding clearance fit on said rail track surfaces (324–330) to permit longitudinal sliding of said door panel therealong as well as said limited range of relative rotation between said slide (100C) and said track (202), and wherein each of said sleeves (105) is held against movement longitudinally relative to said carrier portion (125) of said slide (100C) by forming four retaining detents, one flanking each side of each said glide (105) after installation of said glide (105) to the desired position longitudinally of said carrier (125).

29. The door assembly of claim 28 wherein each of said glides (105) is made of semi-resilient plastic material and hence may be removed sideways by the parting gap being swung open as said glide is pulled laterally off of said carrier (125), and vice-versa relative to replacement installation of said glides (105) as a field service operation.

30. A sliding structural support assembly adapted for movably supporting a panel array or the like, said support assembly comprising:

(a) first and second track C-channel rails each having a hollow interior cross-sectional configuration defining a longitudinally extending hollow interior slideway having a circumferentially interrupted cylindrical slide bearing surface and wherein each said rail is adapted to be supported on a support structure with a major longitudinal axis of each rail extending generally parallel to that of the other rail, each said rail having a longitudinally extending slot opening laterally to the hollow interior slideway of said rail, (b) a panel array support structure having first and second planar support edges juxtaposed to said first and second track channels, (c) a first slide and cap attachment sub-assembly and a second slide and cap attachment sub-assembly respectively each having a panel attachment structure secured respectively to said first and second planar support edges, and extending substantially the full length of the associated said planar support edge, (d) each said slide and cap-attachment sub-assembly having a first leg wall extending therefrom into the hollow interior slideway of the associated one of said rails via said rail slot opening and terminating therein in a glide carrier portion, and (e) each said slide and cap-attachment sub-assembly also including a pair of glides mounted on said sub-assembly first leg wall of said glide carrier portion with said glides of each said pair being spaced longitudinally of said carrier portion and respectively located adjacent the longitudinally opposite ends of the associated said carrier portion and having a slide bearing surface bearing slidably on said slide bearing surface of said slideway of the associated said rail for slidably supporting said panel by sliding motion of said slides along the longitudinal axis of said track rail slideway, said slide bearing surfaces being complemental to one another and each being curved about a radius of curvature centerline extending parallel to said major longitudinal axis of said rail such that each said slide and cap sub-assembly has limited rotational freedom around the sliding axis that permits a limited range of relative rotation about such axis between each said slide and cap sub-assembly and associated rail so that, if either said sub-assembly or rail is twisted during installation or operation, such rotational freedom will compensate for either such twist, thereby enabling said sliding structural support assembly to be mounted with said rails allowed to twist within certain limits when fastened down to conform to non-parallel or non-level structural surfaces to which they are mounted either as manufactured or as distorted in operation by loading causing structural twisting without thereby inhibiting sliding motion of said support assembly along said rails.

31. The assembly of claim 30 wherein each said slide and cap sub-assembly is constructed and arranged to have an adjustable clamping structure secured to their respectively associated panel planar support edges by clamping thereto.

32. The assembly of claim 31 wherein each said slide and cap subassembly includes a main slide formed as an aluminum extrusion of constant cross sectional configuration and extending lengthwise substantially the full width of said planar support edges, said main slide having a U-shaped channel section made up of a central bight wall integrally joined through radiused corners to a second leg wall and to said first leg wall that extend parallel to one another, an outer edge of said second leg wall being joined through a radiused corner to a clamp leg wall that extends with its major plane generally perpendicular to that of said second leg wall and generally parallel to that of said bight wall, said main slide also having a keeper leg wall protruding from said clamp leg wall adjacent said second leg wall and being spaced therefrom to define a slide cap keeper slot therebetween, said clamp leg wall having a planar support edge facing longitudinal edge provided with a small radius protruding lip and a facing surface provided with a row of longitudinally extending teeth for sealably clamping against the associated clamped surface of said planar support edge.

33. The assembly of claim 32 wherein said first leg wall of said slide terminates at its free end in said glide carrier portion, said glide carrier portion being formed as a terminal integral enlargement of said first leg wall and having four longitudinally extending and radially protruding major or thick ribs, each having its major mid-plane oriented at an included angle of about 45 degrees relative to the mid-plane of said first leg wall such that said ribs thus form diametrically oppositely protruding major rib pairs, said glide carrier portion also having a pair of minor or thin ribs formed co-planar with their major plane perpendicular to said first leg wall mid-plane so as to protrude respectively between said first major ribs and between second major ribs, and wherein the outer end edges of said major ribs are edge-rounded and terminate flush with an imaginary circle and wherein the outer end edges of said thin ribs terminate slightly short of said circle, each of said glides being grooved to receive one of said thin ribs and the two of said major ribs flanking said one thin rib, the exterior surface of each said glide being contoured by being curved about said radius of curvature for slidably bearing on said slideway for both said limited relative sliding rotation and longitudinal sliding motion therealong.

34. The assembly of claim 33 wherein each said glide is rectangular in plan view with flat parallel opposite side surfaces, flat and parallel end faces, a flat top surface and oppositely inclined track-engaging slide surfaces intersecting the respectively associated end surfaces at about a 45 degree angle, and wherein each said glide is formed with oppositely angled major grooves complementary in configuration to said carrier major ribs and ribs and a central minor groove complemental to said carrier minor thin ribs, each said glide being made of a plastic material to render said glide semi-resilient, and wherein the material removed in the formation of said grooves thus enables yieldable bending of each glide in a plane perpendicular to said slideway longitudinal axis to thereby widen a gap defined between a pair of rounded edges of associated re-entrant gripping fingers formed in a bottom side of each said glide by the provision of said major grooves.

35. The assembly of claim 34 wherein each said glide is assembled onto glide carrier during manufacture by being oriented adjacent a longitudinal end of said carrier portion with its said grooves aligned with said ribs and then slid sideways onto these ribs to a position inward from the associated end of said carrier portion and then, in order to capture each said glide within a limited range of sliding motion longitudinally of said carrier portion, the associated one of said minor or thin ribs is struck out slightly to produce two limit stop tangs, one on either side of each said glide.

36. The assembly of claim 35 wherein said glides comprise two upper glides and two identical lower glides mounted on each said slide/cap sub-assembly and said glides are identical with one another and are each extruded from a suitable length of material having a cross-sectional configuration defining said grooves as extruded and from which said individual glides are cut at equal length increments.

37. The assembly of claim 36 wherein said glide plastic material comprises a polymer filled with a self-lubricating material.

38. The assembly of claim 37 wherein said glide plastic material is a filled acetal plastic material.

39. The door assembly of claim 35 wherein once said glides have been constrained for limited longitudinal travel on said carrier, said glides still may be individually removed and replaced by peeling off each said glide due to its semi-resilient characteristics and configuration thereby permitting yieldable bending of said glide in a said plane perpendicular to the longitudinal axis of said carrier, and wherein re-installation, or installation of replacement glides, between said travel-limiting strike outs in the center ribs may be accomplished manually as assisted by a suitable hand tool to apply sufficient mounting distortion forces to snap each said glide onto seated position on said associated mounting ribs.

40. The assembly of claim 32 wherein said adjustable clamping structure of each said slide and cap sub-assembly includes a slide cap that is L-shaped in transverse cross section to have wide and narrow leg walls and is co-extensive in length with said main slide and is likewise formed as an aluminum extrusion of constant cross-sectional configuration with said narrow width leg wall designed to slip fit into said keeper slot of said slide so as to be adjustably captured between said second leg wall and said keeper leg wall of said slide in panel-clamping assembly therewith.

41. The assembly of claim 40 wherein said cap wider leg wall is formed with its major plane defining an included angle slightly less than 90 degrees relative to the major plane of said cap narrow leg wall, and wherein said cap in panel-clamping assembly with said slide is oriented with its upper end generally flush with that of said slide, and wherein said cap also has a longitudinal rib at its upper edge, facing said slide rib, and a row of longitudinally extending teeth facing said slide teeth.

42. The assembly of claim 31 wherein said first and second track C-channel rails are identical to one another and each comprise an aluminum extrusion of constant cross-sectional configuration that is generally rectangular as defined by a base wall, a pair of parallel first and second side walls and a front wall made up of first and second lip walls that protrude toward one another, one from each of said side walls such that said lip walls define said longitudinally extending central slot opening therebetween that extends the fall length of each said rail and is open at the longitudinal ends of each said rail.

43. The assembly of claim 42 wherein said rails are provided with a protective coating of either a polyester powder coat having a white coating, or a clear anodized coating.

44. The assembly of claim 42 wherein the interior configuration of each of said rails includes first and second internal shoulder portions provided at the corner junctions of said base wall with said first and second side walls, respectively, said first shoulder portion defining in conjunction with the interior surfaces of said first side wall and the interior surface of said first lip wall a full length first internal groove, and wherein said second internal shoulder in conjunction with the internal surface of said second side wall, and internal surface of lip wall defines a laterally opposite, symmetrically configured second internal groove, and wherein said internal shoulders in conjunction with the internal surface of said base wall define a third internal groove that, like said first and second internal grooves, extends the full length of said track rail channel and is open at the longitudinally opposite ends thereof.

45. The assembly of claim 44 wherein the interior surfaces of said shoulders and said lip walls are curved in a plane perpendicular to the rail longitudinal axis to define four curved, in cross-section, slide bearing surfaces contiguous with an imaginary right cylinder having a radius dimension less than the distance between the axis of said imaginary cylinder and each of first, second and third back walls of said first, second and third grooves respectively, said four curved slide bearing surfaces thereby being curved about said radius of curvature and thereby forming said interrupted cylindrical bearing surface for slidably and rotatably receiving said glides as mounted on said glide carrier portion with surfaces of said glides slidably bearing on said curved track surfaces.

46. The assembly of claim 45 wherein the outside dimensional distance between said exterior sliding surfaces of said slides when assembled on said carrier portion is made just slightly less than the diameter of said imaginary cylinder so that said glides can be inserted endwise with a close sliding fit into the open end of the associated said rail in initial assembly.

47. The assembly of claim 46 wherein the minimum spacing distance between said lip walls defining said slot is sufficiently greater than the thickness of slide leg wall protruding therebetween such that said lip walls serve as pivoting end limit stops so that said slide can only rotate about the rail axis through a limited angular range of about 20 degrees clockwise and about 20 degrees counterclockwise from the centered position of said slide in said associated rail and such that within this predetermined limited slide pivotal range, the sliding bearing of said glides remain in bearing contact with at least a portion of their associated said curved slide track surfaces.

* * * * *